US012588776B2

(12) United States Patent
Östebo et al.

(10) Patent No.: US 12,588,776 B2
(45) Date of Patent: Mar. 31, 2026

(54) DISPENSING ARRANGEMENT FOR DISPENING DRY OR SEMI-DRY PRODUCTS

(71) Applicant: Picadeli AB, Gothenburg (SE)

(72) Inventors: Anton Östebo, Älvängen (SE); Johan Furulind, Gothenburg (CH)

(73) Assignee: PICADELI AB, Gotborg (SE)

( * ) Notice: Subject to any disclaimer, the term of this patent is extended or adjusted under 35 U.S.C. 154(b) by 184 days.

(21) Appl. No.: 18/694,741

(22) PCT Filed: Nov. 4, 2022

(86) PCT No.: PCT/SE2022/051015
§ 371 (c)(1),
(2) Date: Mar. 22, 2024

(87) PCT Pub. No.: WO2023/101587
PCT Pub. Date: Jun. 8, 2023

(65) Prior Publication Data

US 2025/0000289 A1 Jan. 2, 2025

(30) Foreign Application Priority Data

Dec. 2, 2021 (SE) ..... 2151475-7

(51) Int. Cl.
*A47G 19/34* (2006.01)

(52) U.S. Cl.
CPC ..... *A47G 19/34* (2013.01)

(58) Field of Classification Search
CPC ... A47G 19/34; A47F 1/03; A47F 1/10; G07F 11/48; G07F 11/52; G07F 13/02
See application file for complete search history.

(56) References Cited

U.S. PATENT DOCUMENTS 3,138,297 A * 6/1964 Mckinney ..... B65G 7/08 222/567
5,899,358 A * 5/1999 Daumueller ..... G07D 1/00 221/202

(Continued)

FOREIGN PATENT DOCUMENTS

DE 12 25 910 9/1966
EP 3542678 A1 * 9/2019 ..... A47F 1/03

(Continued)

OTHER PUBLICATIONS

International Search Report issued in parent PCT/SE2022/051051, Jan. 30, 2022, pp. 1-2.

(Continued)

*Primary Examiner* — Bob Zadeh
(74) *Attorney, Agent, or Firm* — Jeffrey S. Melcher; Melcher Patent Law PLLC

(57) ABSTRACT

The invention relates to a dispensing arrangement (100) for dispensing dry or semi-dry products comprising a refillable container arrangement (10) with a funnel comprising a container dispensing channel (16) with a lower open end forming a dispensing aperture, and a support structure comprising a bracket element (20) for holding the container arrangement (10). The dispensing arrangement (100) comprises a base member (30) with a closing element (35) and the container arrangement (10) is pivotally mountable to the base member (30;) such that it can be rotated with respect to the base member (30) around a horizontal pivot axis (34) between a first end position in which the closing element (35) covers the container dispensing channel (16) lower open end preventing product dispensing, and a second end position in which a maximum predetermined flow is allowed and in which the closing element (35) at least partly reveals the container dispensing, channel (16) lower open, and at (Continued)

least one releasable dispensing control element (40) arranged to limit the maximum rotation of the container arrangement (10).

15 Claims, 12 Drawing Sheets

(56) References Cited

U.S. PATENT DOCUMENTS

| | | | | |
|---|---|---|---|---|
| 6,182,864 | B1 * | 2/2001 | Elmore | A47F 1/035 222/542 |
| 6,964,355 | B2 | 11/2005 | Landau | |
| 8,678,236 | B2 | 3/2014 | Burke | |
| 9,400,200 | B2 | 7/2016 | Rusch | |
| 2011/0062187 | A1 * | 3/2011 | Johnson | A47F 1/035 222/153.14 |
| 2025/0000289 | A1 * | 1/2025 | Östebo | A47G 19/34 |

FOREIGN PATENT DOCUMENTS

| | | | |
|---|---|---|---|
| FR | 1 377 403 | | 11/1964 |
| FR | 1377403 | A * | 11/1964 |

OTHER PUBLICATIONS

Written Opinion issued in parent CT/SE2022/051051, Jan. 30, 2022, pp. 1-5.

* cited by examiner

40''''

40''''

40''''

DISPENSING ARRANGEMENT FOR DISPENING DRY OR SEMI-DRY PRODUCTS

TECHNICAL FIELD

The present invention relates to a dispensing arrangement having the features of the first part of claim 1. The invention particularly relates to a dispensing arrangement for dispensing dry or semi-dry products, e.g. food products, toppings or other products in granular form or in powder form or similar. The invention also relates to a use of a dispensing arrangement in connection to a food bar arrangement, e.g. a salad bar.

BACKGROUND

Fresh food, salads, fruit, vegetables, but also cooked, prepared food and healthy food is today often offered from a food bar, or a salad bar, where the customer can pick and compose a meal from a number of different products e.g. kept in canteens or pans. Such, and other open food displays, are an attractive way to offer fresh food to consumers in retail stores, restaurants, and other areas.

Such food bars or open food displays are accessed by several persons and it is important to maintain a high level of food safety. Often there is a desire to offer toppings, e.g. dry or semi-dry food in association with such salad bars from dispensing arrangements, here also called topping dispensers. Topping dispensers are also used as stand-alone arrangements, for other eatable products as well.

Common for all such dispensing arrangements is that hygienic requirements are high, they should be easy to refill, maintain, clean for a service provider (e.g. vendor of food products or staff responsible for dispensing arrangements) and easy to use for clients (e.g. buyers of food products). There is also often a need to offer several different toppings, e.g. dry or semi-dry products having different properties, e.g. different granular sizes etc.

Several different so called topping dispensers are known, but they all suffer from disadvantages as far as maintenance, refilling, operation for users as well as operators or maintenance staff With known topping dispensers it is also difficult to handle food products, e.g. dry or semi-dry, comprising particles or granules having different sizes and shapes. It is also difficult to maintain the desired hygienic standards which is a problem since foodborne illnesses constitute a serious problem and it is well known that bacteria, fungi, viruses, and other pathogens can survive, and bacteria, fungi etc. can replicate and grow on food under certain conditions, in particular if a topping dispenser is not sufficiently easy to handle, to clean and to use and products may be left in the topping dispenser also while new products are added. It is associated with several problems and difficulties to further increase the food safety as far as dispensing arrangements are concerned, not least due to the frequent risk of contamination due to several individuals accessing them.

U.S. Pat. No. B 8,678,236 shows a dispenser for dispensing serving portions of topping onto beverages and desserts. It comprises a first compartment portion and a second compartment portion which is hinged to the first compartment portion. One of the compartment portions includes a backing surface and a bag holding member operable to releasably attach a product bag to the compartment portion adjacent the backing surface. The other compartment portion includes a squeeze member, e.g. a cylindrical roller, mounted for travel in upward and downward directions. The squeeze member is arranged to contact the product bag when the second compartment portion is closed relative to the first compartment portion. The dispenser also comprises an actuating lever mechanically connected to the squeeze member, for example by a one-way advancing mechanism, wherein the actuating lever is operable by a user to advance the squeeze member in the downward direction to dispense product.

U.S. Pat. No. 9,400,200B2 and U.S. Pat. No. 6,964,355B2 show other examples of topping dispensers.

However, these as well as other known topping dispensers all suffer from not being sufficiently easy to handle, to clean, to fabricate, mount and replace, are relatively space-demanding and all leave a lot to desire.

SUMMARY

It is therefore an object of the present invention to provide a dispensing arrangement as initially referred to through which one or more of the above-mentioned problems can be solved.

It is a particular object to provide an improved dispensing arrangement.

It is a particular object to provide a dispensing arrangement which is easy to use for an end user, a customer.

It is also an object to provide a dispensing arrangement that is easy to use and handle for service personnel.

It is particularly an object to provide a dispensing arrangement through which high demands on food safety can be met.

Another object is to provide a topping dispensing arrangement that is flexible, space efficient and can be used for different types of dry or semi-dry food particles, e.g. in granular form or powder form, e.g. also such food particles having different shapes and sizes.

Another particular object is to provide a dispensing arrangement which is reliable and enables or facilitates fulfilment of high safety standards, both as far as food safety is concerned e.g. for dry food products, e.g. topping or similar, quality and freshness.

It is also an object to provide a dispensing arrangement which is easy to install and to modify allowing dispensing of different dry or semi-dry food particles or other products, particularly granular food products, and also allowing an appropriate dosage, flow, thus allowing the flow of dry or semi-dry product particles, e.g. topping, to be controllable.

Still another particular object is to provide a dispensing arrangement that enables a good flow of e.g. dry or semi-dry food products.

Yet another particular object is to provide a dispensing arrangement which is easy and cheap to fabricate.

Therefore a dispensing arrangement as initially referred to is provided which has the characterizing features of claim 1.

Advantageous embodiments are given by the dependent claims.

BRIEF DESCRIPTION OF THE DRAWINGS

The invention will in the following be further described, in a non-limiting manner, and with reference to the accompanying drawings, in which.

DETAILED DESCRIPTION

Figure 1:
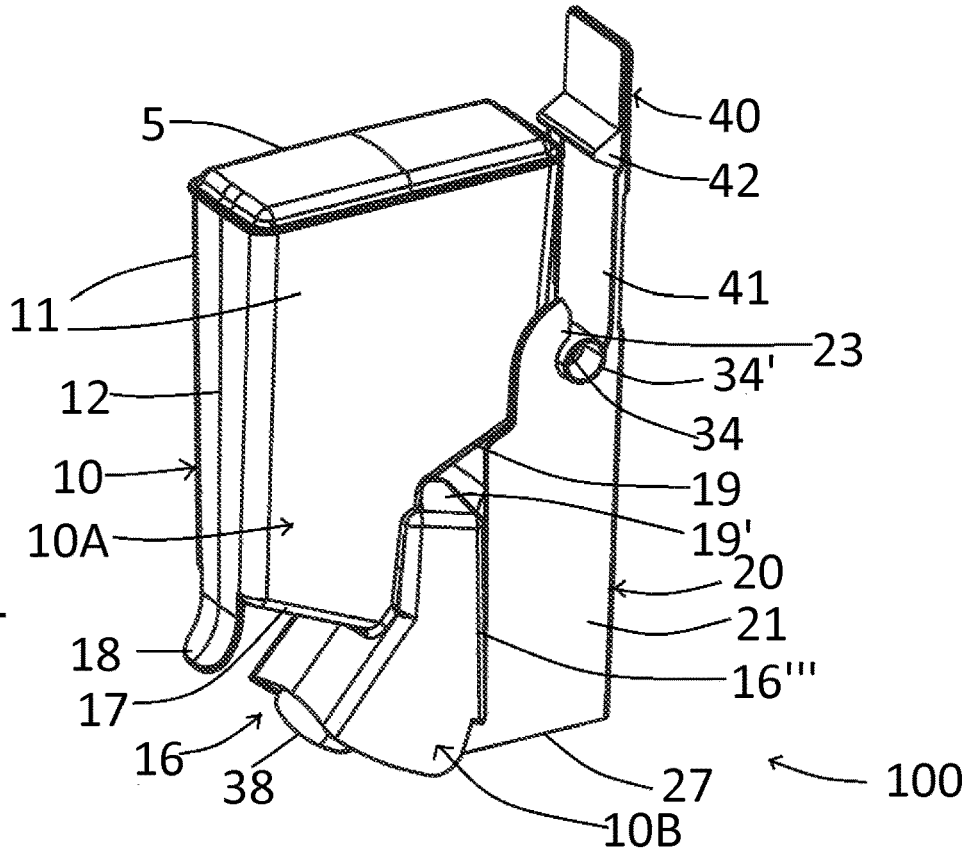
FIG. 1 is a schematic view in perspective of an exemplary dispensing arrangement with a container member according to one embodiment of the invention.

FIG. 1 shows a first embodiment of a dispensing arrangement 100 according to the invention, e.g. for sprinkling dry or semi-dry food products in granular or powder form, e.g. toppings or topping mixes, of different types, e.g. of different granular or particle sizes, different consistencies etc., over for example a food product, e.g. a salad composed from products offered in a salad bar or similar. In FIG. 1 the dispensing arrangement 100 is in an assembled state for mounting e.g. on a wall or similar, but in a state in which dry or semi-dry food products in granular or powder form or similar, is prevented from being dispensed as will be further described below, i.e. in a non-operative state. In the following reference will be made to a topping dispensing arrangement although it should be clear that the inventive concept is not limited to toppings; it may be any dry or semi-dry food products or other products comprising particles, granules or grains, products in form of a powder or similar.

The dispensing arrangement 100 comprises a container arrangement 10, a bracket element 20, e.g. for mounting on a wall or any other substantially vertically disposed surface, and to which the container arrangement is releasably connectable. The dispensing arrangement 100 further comprises a base member 30, the base member 30 and the container arrangement 10 being adapted and designed so as to allow them to be releasably interconnected through an upper pivot pin or shaft 34, which is substantially horizontally disposed, in a mounted state of the topping dispensing arrangement 100, on the base member 30 being receivable in a rear tubular member or bushing 14 of the container arrangement 10 while the base member 30 partly is taken up between lower side wall portions 16',16' of the container arrangement 10. The container arrangement 10 and the base member 30 in an interconnected or assembled state will share a common pivot axis around which the container arrangement 10 can be rotated outwards, upwards as will further described below, while the base member 30 is kept in a same position in the bracket element 20, allowing dispensing of dry or semi-dry food products in granular or powder form or similar. Thus, the container arrangement 10 itself is moving when used/activated allowing dry or semi-dry food products in granular or powder form or similar to be agitated and guided downwards avoiding the dry or semi-dry food products in granular or powder form or similar from being stuck. This makes it suitable for a large variety of dry or semi-dry food products in granular or powder form or similar products having different granular or particle sizes and different consistencies.

Figure 2:
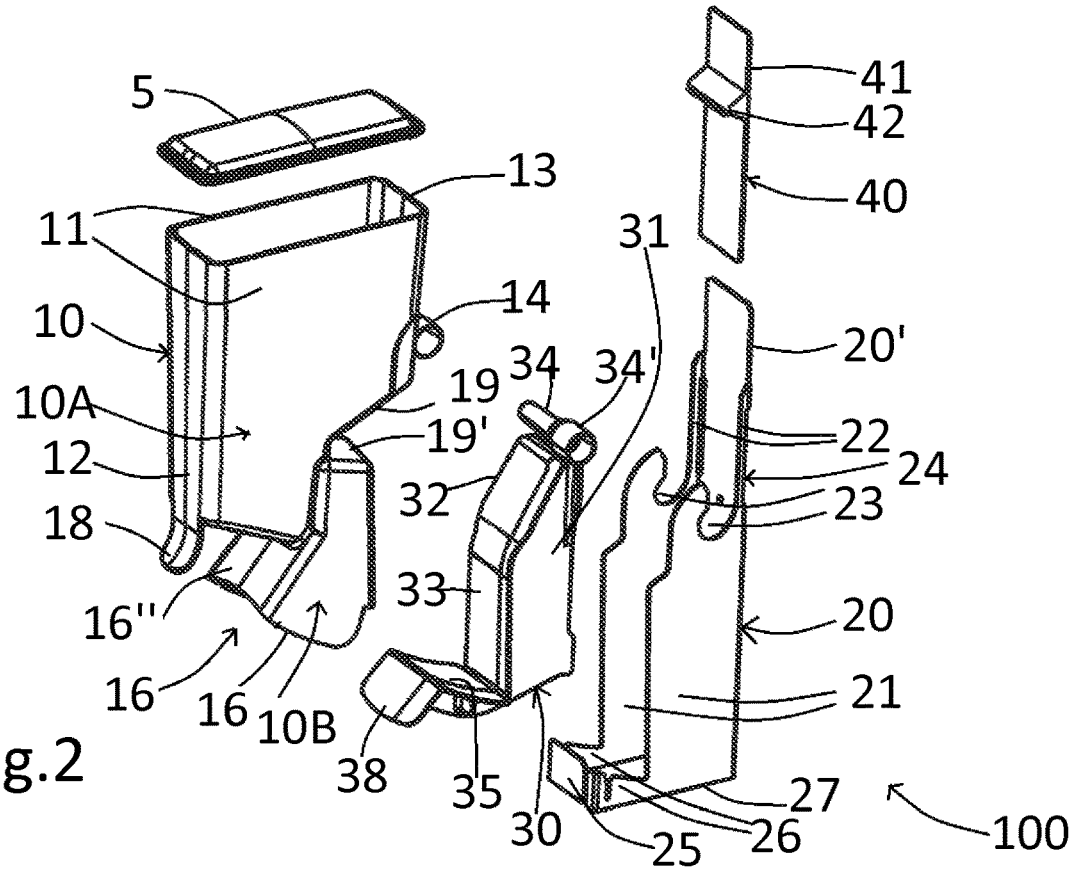
FIG. 2 is a schematic view in perspective of the elements forming the dispensing arrangement shown in FIG. 1 in a non-assembled state.

The base member 30 is in the assembled state partly taken up within a lower portion 10B of the container arrangement 10 and the container arrangement 10 comprises a lower exit channel or container dispensing channel 16 and wherein, in an assembled state when the container arrangement 10 is associated with the base element 30 as shown in FIG. 1, dry or semi-dry food products in granular or powder form or similar are prevented from being dispensed through a closing element 35 provided on the base member 30, see FIG. 2.

The container arrangement 10, shown in a state when the dispensing arrangement 100 is assembled in FIG. 1, and in a non-assembled state in FIG. 2 for facilitating the description thereof, comprises an upper container portion 10A for reception of and holding of a dry or semi-dry food product in granular or powder form or similar and a lower container portion 10B also holding a dry or semi-dry food product in granular or powder form or similar and through which the dry or semi-dry food product in granular or powder form or similar passes for being dispensed. An upper part of the upper container portion 10A here has a substantially rectangular cross-sectional shape, and comprises two parallel side walls 11, a front wall 12 and a rear wall 13 ending closer to the receiving opening than the front wall 12. A lid or cover 5 is used for closing the container arrangement 10, i.e. the upper, product receiving, container portion 10A, e.g. when the container arrangement 10 contains a desired dry or semi-dry food products in granular or powder form or similar or as a protection before a dry or semi-dry food products in granular or powder form or similar is entered into the container arrangement 10. Prior to usage the container arrangement 10 is filled up with a dry or semi-dry food products in granular or powder form or similar of choice; the dry or semi-dry food products in granular or powder form or similar is enclosed in the container arrangement 10 to ensure freshness.

A lower end of the container front wall 12 protrudes from associated perpendicularly disposed lower end edges of the side walls 11,11, the front wall 12 hence being longer than the side walls 11,11, the lower protruding portion being somewhat angled outwards with respect to the container arrangement 10 to serve as an actuating element 18 for pulling or gripping by an end user for dispensing of the dry or semi-dry food product in granular or powder form or similar held in the container arrangement 10 through pivoting or rotating the container arrangement 10 as discussed above, and, vice versa, for closing through pushing or gripping the actuating member 18 rotating the container arrangement 10 in the opposite direction, also allowing regulating the exit flow of dry or semi-dry food products in granular or powder form or similar depending on the amount of rotation, the maximum flow being limited by means of an upper rear edge on the rear wall 13 of the upper container portion 10A contacting a blocking protrusion 42 of dispensing control element 40 as will be further described below, hence blocking the container arrangement 10 from being rotated beyond a pre-defined maximum angle.

The rear wall 13 of the container arrangement 10 is shorter than the opposite front wall 12 and ends closer to the receiving portion or upper edge of the container arrangement 10 upper portion. At a distance from the upper end of the rear wall 13, a tubular element 14, a bushing or a bearing or similar, is securely fixed to the rear wall 13, or made in one piece therewith, allowing reception of the shaft or pivot pin 34 of base member 30 as referred to above. The tubular element or bushing 14 is horizontally disposed, perpendicularly to the side walls 11,11, in use in a mounted state of the topping dispensing arrangement 100 on a bracket element 20 e.g. secured to a wall or similar. In the shown embodiment, at lower edges of the parallel side walls 11,11 of the upper container portion 10A, a forwardly, downwards slanting relieving wall section 19 is arranged which, at a distance from the front wall 12, somewhat closer to the front wall 12 than to the rear wall 13, turns into a slightly rearwards sloping upper wall 19' of the lower container portion 10B.

The side walls 11,11 of the upper container portion 10A hence are narrower at a lower part of the upper container portion 10A and at the lower parts are interconnected by means of a front bottom wall 17 here being inclined somewhat upwards, outwards towards the front wall 12, at a front edge connecting to the actuating element 18. A rear edge of the front bottom wall 17 is connected to an upper vaulted top wall of lower container portion 10B forming a side wall 16',16' interconnecting wall above or forming a part of the container dispensing exit channel 16, said exit channel 16 being directed outwards, downwards (with respect to e.g. a bracket element 20 adapted for vertical mounting, e.g. on a wall or similar).

Figure 9:
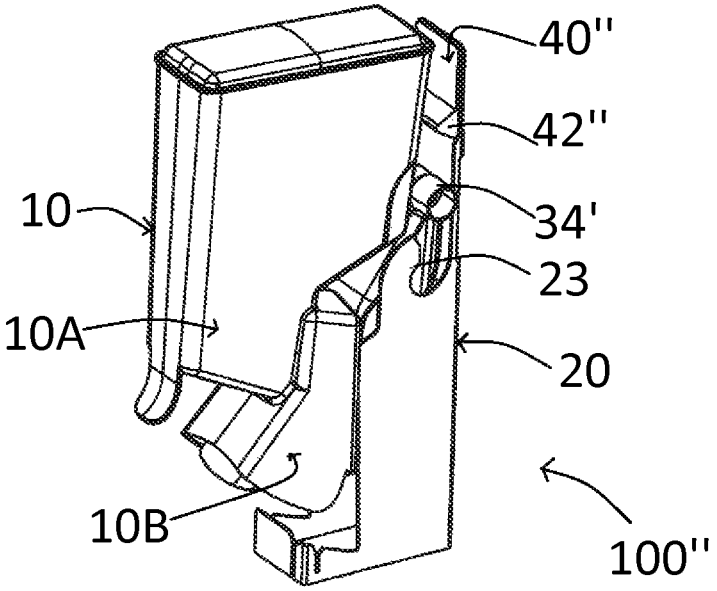
FIG. 9 shows the elements of the dispensing arrangement of FIG. 5 in a fourth assembling state in which the container arrangement and base member assembly is in a position for the pivoting axis to be received and held by parallel receiving recesses of the bracket member side walls when the assembly is moved vertically downwards.
Figure 10:
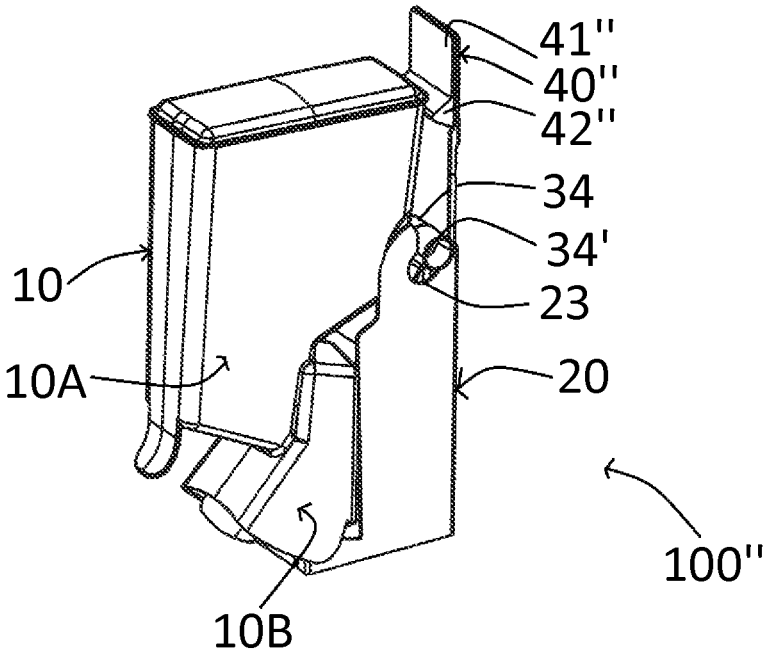
FIG. 10 shows the elements of the dispensing arrangement of FIG. 5 in a fifth assembling state in which the container arrangement and base member assembly has been moved downwards in a state just before being completely assembled.
Figure 11A:
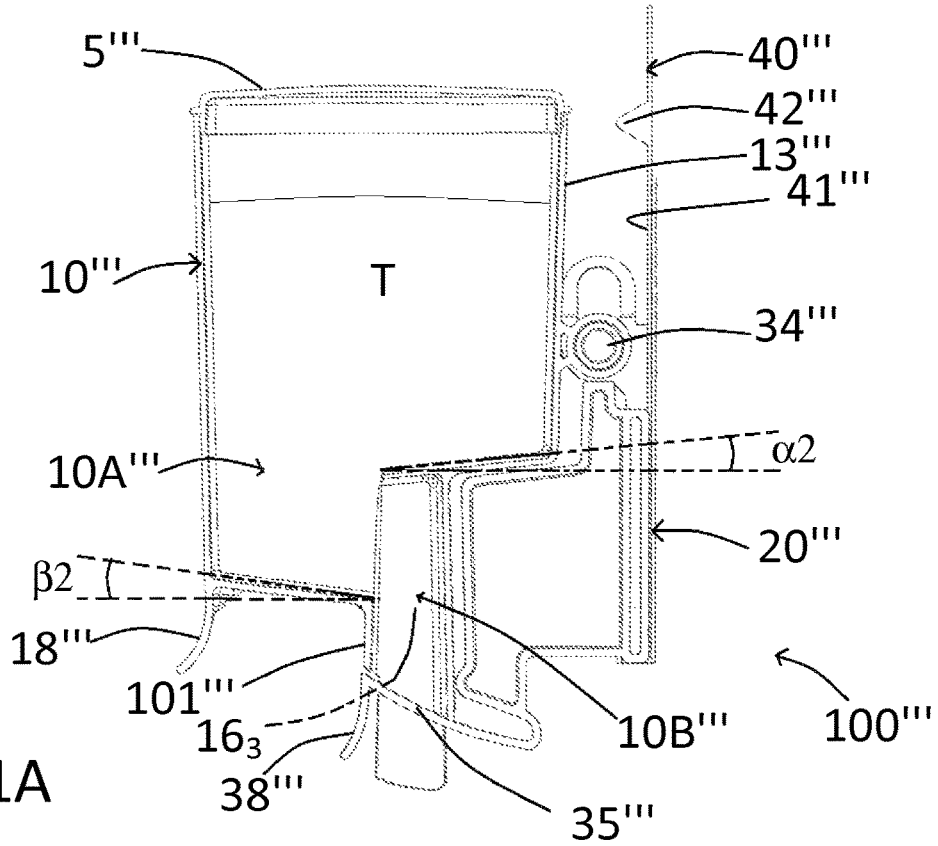
FIG. 11A is a schematic cross-sectional view through an alternative embodiment of a dispensing arrangement in a first, closed, state.
Figure 11B:
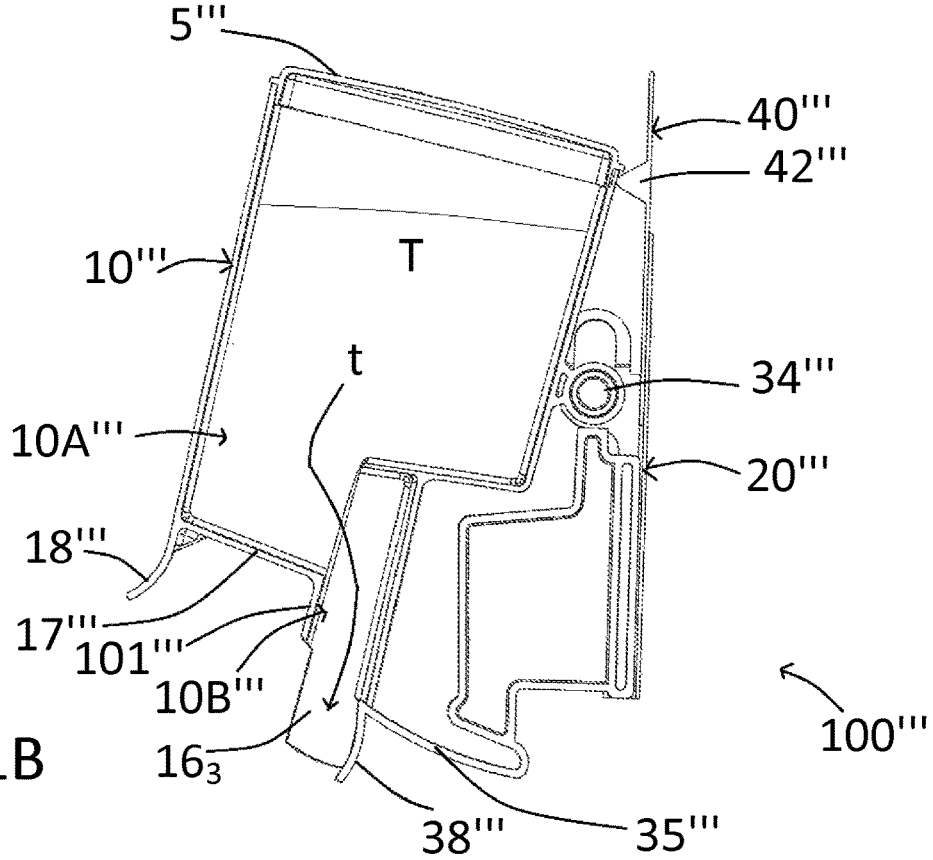
FIG. 11B is a schematic cross-sectional view through the dispensing arrangement of FIG. 11A in a second, open, dispensing state.
Figure 12A:
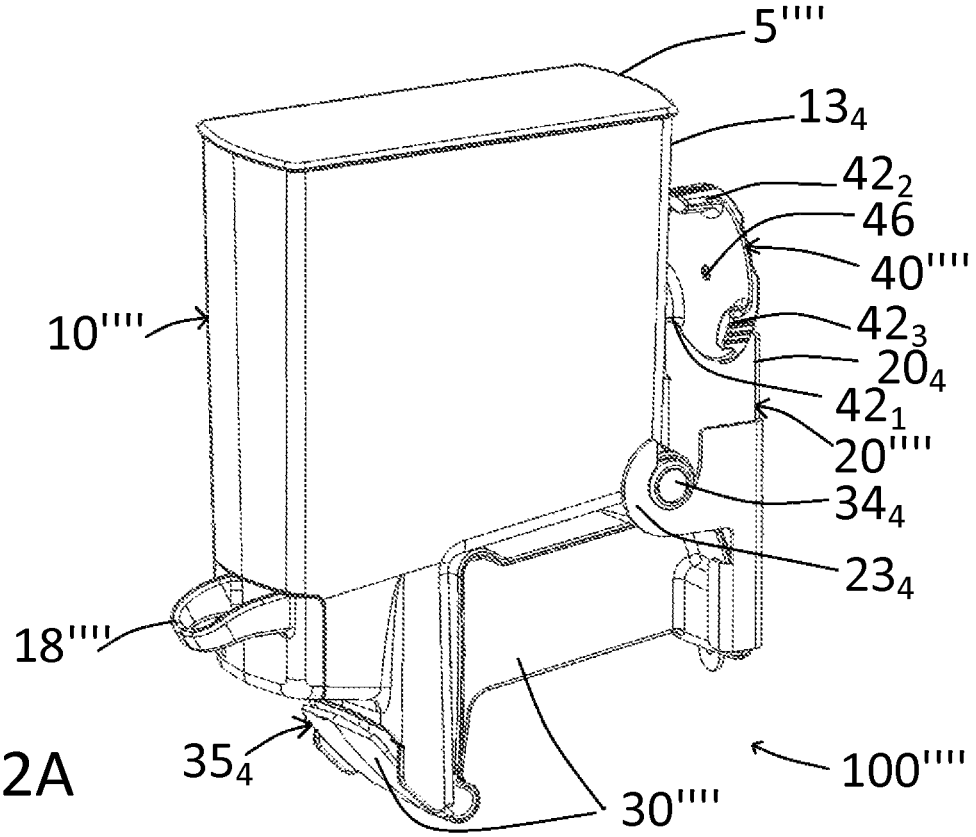
FIG. 12A is a schematic view in perspective of still another embodiment of a dispensing arrangement in a first, closed, state.
Figure 12B:
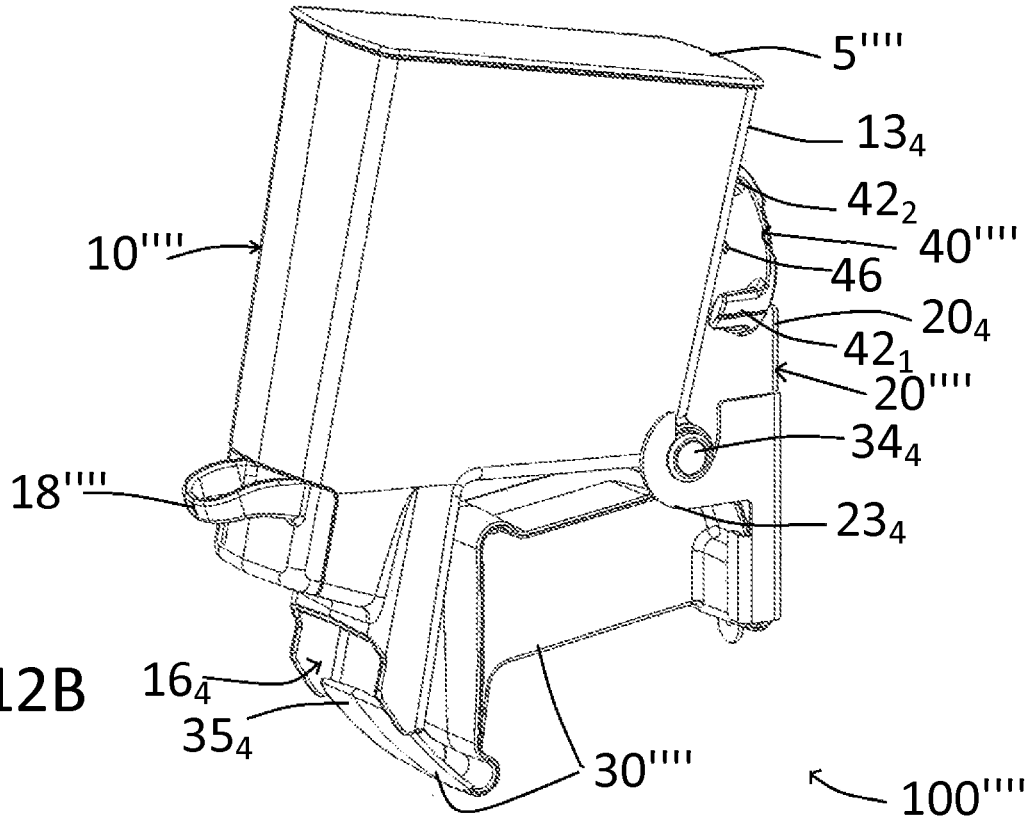
FIG. 12B is a schematic view in perspective of the dispensing arrangement of FIG. 12A in a second, open, dispensing state.

It should be clear that the inventive concept is by no means limited to a container arrangement having a shape as disclosed with reference to FIGS. 1-10, but it can have many other shapes and dimensions, one example of which being schematically illustrated in FIGS. 11A,11B, another example being illustrated in FIGS. 12A,12B. In particular, the downwards slanting relieving wall section 19 and the sloping upper wall 19' of the container lower portion 10B merely serve the purpose of providing a buffering zone for dry or semi-dry food products in granular or powder form or similar in the container arrangement in order to avoid the products being distributed in a non-desired manner in the container arrangement and for facilitating cleaning, avoiding collection of water respectively, which can be provided for in many different manners; they may even be entirely disposed of (cf. embodiment shown in FIGS. 11A,11B).

A lower front portion of the upper portion 10A of the container arrangement 10 is thus closed by front bottom wall 17 and, at a rear edge of said front bottom wall 17, opens into an upper rear part of the lower container portion 10B formed by side walls 16',16', rearwards sloping upper wall 19'. The upper rear part of the lower container portion 10B is provided behind and above the front bottom wall 17, and connects to, turns into, the container dispensing or exit channel 16 allowing dispensing of topping or similar. The container dispensing or exit channel 16 is here formed between two parallel side walls 16',16' of the lower container portion 10B, an inner downwardly protruding wall 101 (cf. FIGS. 3C,3D) (located below a side wall 16',16' interconnecting wall 16" which will not get in contact with dispensed dry or semi-dry food products in granular or powder form or similar) and channel rear wall 16'''. The interconnecting wall 16" is vaulted and here disposed to form an angle of between 60° and 150° with the front bottom wall 17, pointing forwardly, outwardly in a mounted state of the dispensing arrangement 100 on a wall or the bracket element 20 on which the dispensing arrangement 100 is to be mounted in a vertical position for allowing dispensing of dry or semi-dry food products in granular or powder form or similar when the container arrangement 10 is rotated about shaft or pivot pin 34 through actuation of the front wall actuating element 18 (see FIG. 3B), moving it slightly outwards, upwards. The inner downwardly protruding wall 101 here extends in parallel to the channel rear wall but its lower edge is located higher up in a vertical position of the container arrangement 10. The closing element 35 and the lower edges of the rear channel wall 16" and downwardly protruding wall 101 forming a front channel wall are so dimensioned and shaped with respect to one another that, when the container arrangement 10 is rotated outwards, to a dispensing state, the closing element 35 will gradually move to uncover the container dispensing channel 16 which will be gradually opened. The closing element 35 in transversal cross-section in some advantageous embodiments has a shape of a circular arc, the radius corresponding to the distance to the pivot axis of the shaft or pivot pin 34.

The base member 30 of the dispensing arrangement 100, which at an upper end is provided with a shaft or pivot pin 34 holder 34' fixedly connected thereto, comprises a central side wall 31 (or two side walls disposed in parallel; not shown) the, or each, side wall comprising a substantially rectangular lower section and an upper section having a tapering front edge on top of which an upper inclined wall 32 is provided which connects to said shaft or pivot pin 34 holder 34' with the shaft or pivot pin 34 protruding on one side thereof and is adapted for reception in the tubular member 14 of the container arrangement 10. On an upper inclined section of the side wall 31 and on a vertical lower edge section of the central side wall 31 said upper inclined wall 32 and a lower vertical wall 33 (i.e. vertically disposed in a mounted non-dispensing state of the topping dispensing arrangement 100) respectively are disposed, perpendicularly to said side wall 31, here the lower vertical wall 33 forming an angle larger than 90° with said upper wall 32. At a lower edge of the lower vertical wall 33 an outwardly, forwardly protruding closing element 35 is disposed which has a same width as the lower vertical wall 33, arranged to form an angle with said lower vertical wall 33, inclined in an upwards, forward direction, and serving as a container dispensing channel 16 closure preventing dispensing of dry or semi-dry food products in granular or powder form or similar through the container dispensing or exit channel 16 when the container arrangement 10 and the base member 30 are assembled, the pivot pin or shaft 34 taken up in the tubular element 14, and arranged in a vertical, non-dispensing position as shown e.g. in FIG. 1. A rear edge of the closing element 35 connecting to the lower vertical wall 33 in a mounted, non-dispensing state, is adapted to the shape and dimensions of a lower edge of the channel rear wall and is disposed such that its front edge will be in contact with the lower edge of the inner downwardly protruding wall 101 (see FIG. 3C), closing the container dispensing channel 16. The base member 30 and the container arrangement 10 are so dimensioned and shaped with respect to one another that when the shaft or pivot pin 34 is taken up in the tubular element 14, the base member side wall 31 will be partly taken up and fitted within side walls 16',16' of the lower portion 10B of the container arrangement 10.

When the container arrangement 10 and the base member 30 are assembled, a rear vertical wall 16''' interconnecting the two parallel side walls 16',16' of the lower container portion 10B will form a bottom portion or rear wall of the container dispensing or exit channel 16 that, depending on the rotation of the container arrangement 10 is closed by the closing element 35, or allows a controlled dispensing flow depending how much the container arrangement 10 is rotated around the pivot axis, but limited to a maximum rotation angle by means of protruding portion 42 of dispensing control element 40 blocking the rotation movement.

At an outer end of the closing element 35, a product guiding element 38 is provided, the purpose of which merely being to guide dispensed dry or semi-dry food products in granular or powder form or similar in a desired direction. It is arranged to form an angle of substantially 90° with the closing element 35; it can be arranged to form any other appropriate angle with the closing element 35, larger as well as smaller, have any appropriate shape, or even be disposed of.

The bracket, or mounting, element 20 is, as referred to above, adapted for mounting on a wall, cabinet or similar in any appropriate way, e.g. by means of screws, bolts or hooks etc. It is not of relevance for the functioning of the inventive concept how it is mounted or arranged on a carrier such as e.g. a wall; preferably but not necessarily it is adapted for substantially vertical mounting.

The bracket element 20 here comprises an upper elongate substantially flat member 20' e.g. of metal, plastic, stainless steel, or any other appropriate material. At a lower portion the bracket element 20 it is equipped with a housing portion comprising two parallel side walls 21,21, a downwardly protruding section of the upper elongated member 20' forming a rear wall 24, and a bottom section 27 with upwardly protruding side edge portions 26 and an upwardly protruding front edge 25 forming a bottom receiving section for reception of the base member 30; see FIG. 2.

The upwardly protruding edges 25,26,26 and side walls 21,21 serve the purpose of holding an assembled container arrangement 10 and base member 30 in place. The upper elongate substantially flat member 20' comprises, at a distance from an upper edge thereof, two flange elements 22,22 arranged in parallel on opposite longitudinal edges of the upper elongate substantially flat member 20' to allow releasable reception of a dispensing control element 40 which can be vertically inserted therein from the top, and held in place by the flange elements 22,22.

The bracket element 20 further comprises two connection portions 23,23 allowing reception of the pivot pin, or shaft, 34 protruding on either sides of an assembly comprising the container arrangement 10 and the base member 30 when assembled, such that the base member 30 will be taken up between the side walls 21,21 of the bracket element 20, an inner end of product guiding element 38 resting on the upwardly protruding edge 25, and extending outwardly, forming an angle therewith.

The dispensing control element 40 here comprises a flat band shaped element 41 of an elongate rectangular shape having a width allowing it to be received and held between the flange elements 22,22 of the bracket element 20 through insertion from above and sliding between the flanges 22,22 adjacent the elongate substantially flat member 20' and in a mounted state forming a longitudinal extension thereof. On the flat band shaped element 41, at a distance from its upper edge, a blocking protrusion 42 is provided which is directed outwards in a direction perpendicular to the longitudinal extension of the flat band shaped element 41 and has a width substantially corresponding to the width of the rear wall 13 of container arrangement 10. The blocking protrusion 42 is thus located in a horizontal direction in a mounted state of the dispensing arrangement 100 and is arranged to block a rotational movement of the container arrangement 10 beyond a predetermined angle around the pivot axis, depending on which dry or semi-dry food products in granular or powder form or similar that is to be dispensed, hence acting as a rotation end stop of the container arrangement 10 during a dispensing operation by the rear wall of the container arrangement 10 getting in contact with the blocking protrusion 42, here the upper edge of the rear wall 13. For different dry or semi-dry food products in granular or powder form or similar different dispensing control elements 40 may here be selected, having different protruding length of the blocking protrusion 42 perpendicularly to the flat band shaped element 41, or in some other way protruding from an element releasably connectable to the bracket member 20. In the shown embodiment the blocking protrusion has a triangular cross-sectional shape; it may have any other appropriate shape or form. It may be fixedly connected to the dispensing control element 40, or be made integrally therewith, or even be releasably connectable thereto.

Figure 3A:
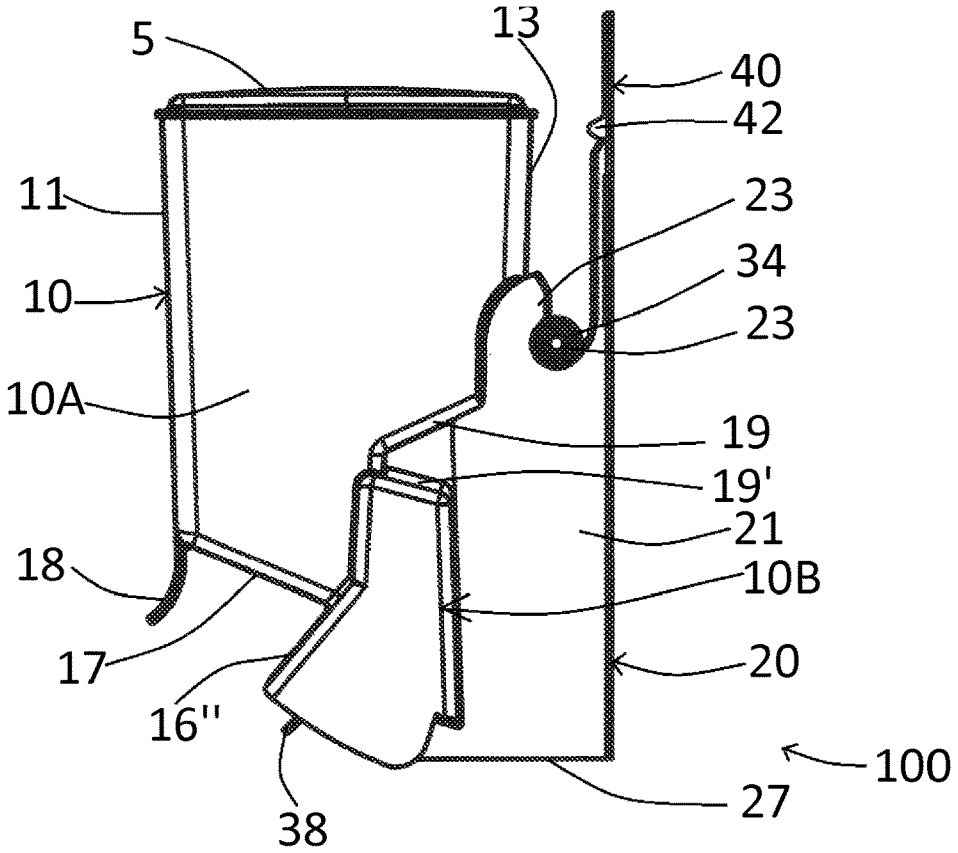
FIG. 3A is a schematic side view of the dispensing arrangement shown in FIG. 1 in a first, closed, state in which product dispensing is prevented.

FIG. 3A is a schematic side view of a dispensing arrangement 100 in an assembled state as shown in FIG. 1 in which the dispensing is not allowed, the container arrangement 100 being disposed in a substantially vertical position with respect to the bracket element 20 rear wall 24. It comprises a blocking protrusion 42 having a short protruding length x (see FIG. 3C) allowing a comparatively large rotation of the container arrangement 10. Since all elements have already been described with reference to FIGS. 1,2, they will not be further described here.

Figure 3B:
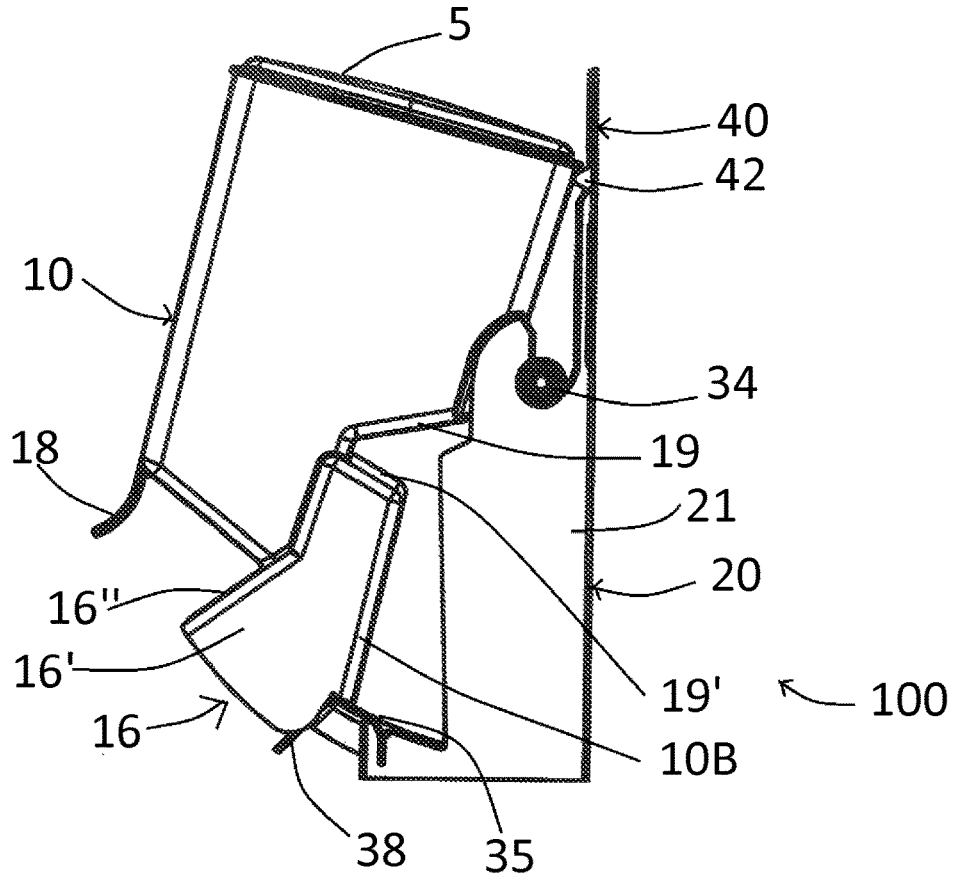
FIG. 3B is a schematic side view of the dispensing arrangement of FIG. 3A in an open, dispensing, state allowing product dispensing.

FIG. 3B is a schematic side view of a dispensing arrangement 100 in an assembled state as shown in FIG. 1 in which dispensing at a maximum flow for a selected dry or semi-dry food products in granular or powder form or similar is allowed, the upper edge of the rear wall 13 of the container arrangement 10 being in contact with, and blocked from further rotation by the blocking protrusion 42 of dispensing control element 40 allowing dry or semi-dry food products in granular or powder form or similar to be dispensed through the container dispensing channel 16. The container arrangement 10 has thus been rotated in a clockwise manner through being lifted or gripped via the front wall actuating element 18. In other respects the elements shown will not be further discussed for having already been discussed with reference to FIGS. 1,2 and 3A,3B.

Figure 3C:
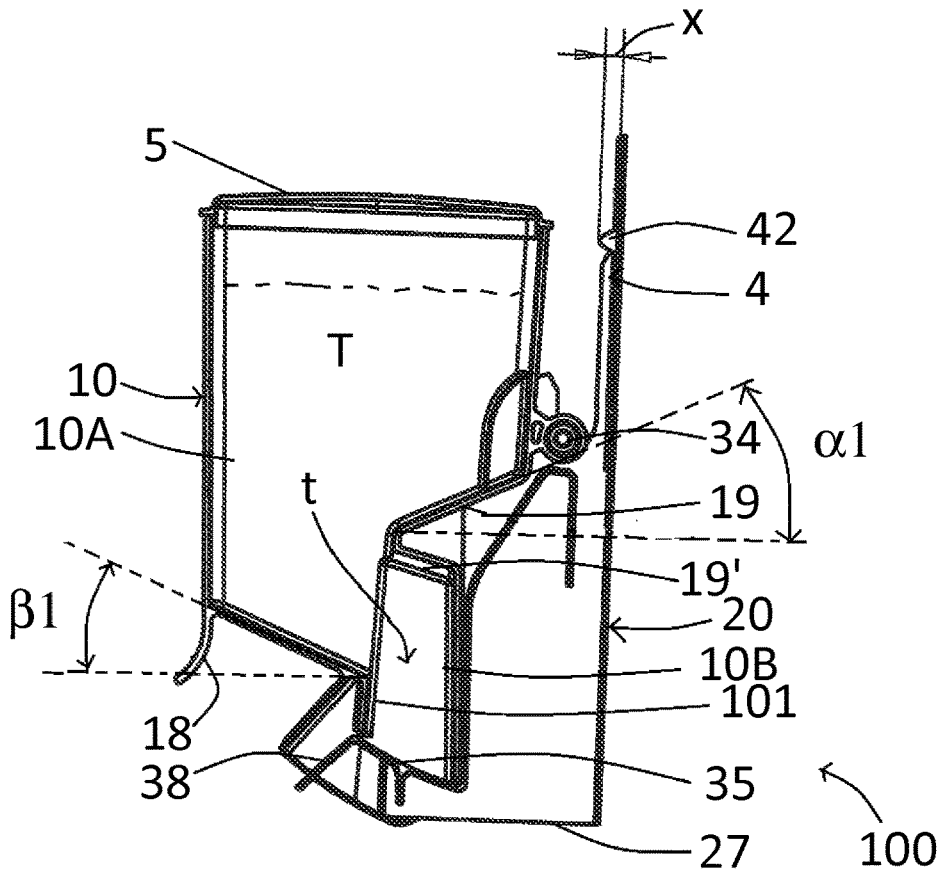
FIG. 3C is a schematic sectional view through the dispensing arrangement in the first, closed, state shown in FIG. 3A.

FIG. 3C is a schematic sectional view through the dispensing arrangement 100 in the first, closed, state shown in FIG. 3A illustrating the protruding length x of the blocking protrusion 42. In FIG. 3C topping content T and an exemplary upper filling level, through a dashed line, the arrow t schematically illustrating flow of dry or semi-dry products in granular or powder form from upper container portion 10A to lower container portion 10B with the closing element 35 of base member in a position preventing dispensing of dry or semi-dry products in granular or powder form through the container dispensing channel 16. An inner downwardly protruding container wall 101 here extends downwardly from the front bottom 17 of the upper container section 10A into the lower container portion 10B ending a short distance from the outer edge of the closing element 35 assisting in preventing dispensing of dry or semi-dry products in granular or powder form in that its lower edge in a non-dispensing state, when the container arrangement is in a substantially vertical state, is arranged to be in contact with outer edge of closing element 35. The provisioning of both an inner wall serving as an upper channel wall 101 and a side wall interconnecting wall 16" as showed herein is not indispensable for the functioning of the inventive concept; cf. an embodiment described with reference to FIGS. 11A,11B, where there is no separate interconnecting wall 16" interconnecting side walls 16',16'.

In embodiments described with reference to FIG. 1-FIGS. 3A-3D, the angle $\alpha 1$ between downwards slanting receiving wall 19 in the container arrangement 10 and a horizontal plane may be around 0-30°, the figures merely being given for exemplifying and by no meaning limiting reasons. The angle $\beta 1$ between inner downwardly protruding container wall 101 and a horizontal plane here is substantially between 0° and 30°, the figures merely being given for exemplifying and by no meaning limiting reasons; c.f. e.g. FIGS. 11A,11B describing exemplary alternative embodiments.

Figure 3D:
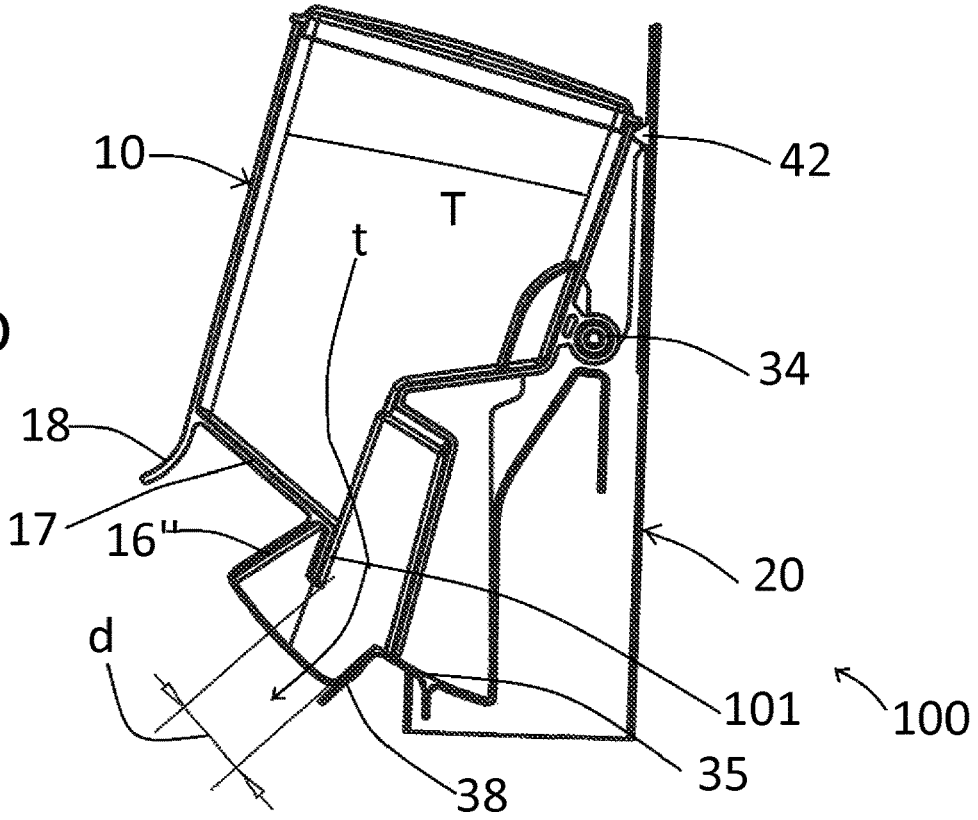
FIG. 3D is a schematic sectional view through the dispensing arrangement in the second, open, dispensing, state shown in FIG. 3B.

FIG. 3D is a schematic sectional view through the dispensing arrangement 100 in the dispensing state shown in FIG. 3B allowing maximum dispensing flow. As can be seen from FIG. 3D, the upper edge of the rear wall 13 of the container arrangement 10 is in contact with, and blocked from further rotation by, the blocking protrusion 42 of dispensing control element 40 allowing dry or semi-dry products in granular or powder form to be dispensed through the container dispensing channel 16, and d illustrates the distance between the lower edge of downwardly protruding container wall 101 serving as an upper container dispensing channel wall and a front edge of the closing element 35. If the container arrangement 10 is not rotated as much as allowed, i.e. without the upper edge of the rear wall 13 contacting the blocking protrusion 42, the outflow of topping will be reduced, i.e. slower. In a non-operational state, i.e. when the dispensing arrangement is assembled but not in use for dispensing, e.g. as shown in FIGS. 1, 3A,3C topping will remain in the container arrangement 10. To use the food dispensing arrangement 100, the container arrangement 100 is rotated upwards until the closing element 35 will not cover the dispensing channels 16 exit, gradually, depending on an increasing rotation angle, allowing more dry or semi-dry products in granular or powder form to emerge from the container arrangement 10 as a result of being subjected to a gravitational force, until the container arrangement 10 is blocked from further rotation by the blocking protrusion 42.

FIG. 3D thus illustrates a maximum rotation of container arrangement 10 for a selected blocking protrusion 42, where the upper edge of the rear wall 13 is blocked by the blocking protrusion 42 of the dispensing control element 40 which is mounted in the bracket element as discussed above. The blocking protrusion 42 is dedicated for a specific dry or semi-dry product in granular or powder form, or a specific type thereof and has a specific length x controlling the maximum allowed rotation angle of the container arrangement 10.

Through demountable, dedicated dispensing control elements 40, the possibility to adapt a dispensing arrangement 100 for dry or semi-dry products in granular or powder form with granule particles of various sizes and having different consistencies, which may require different exit flows for a smooth user experience, is provided, which is extremely advantageous. As referred to above, the dispensing control element 40, also called an end stop, is an exchangeable component available in different options, with different blocking protrusions, providing different allowed maximum rotational angles for the container arrangement 10. In some embodiments the dispensing control element 40, or the end stop, may be provided with or contain information (not shown) about the topping, or for which type of topping it may be used, or any other desired information for the dispensing arrangement holder, or staff, or alternatively or additionally also information for end users or customers decreasing the risk of mismatching desired exit flow for a particular dry or semi-dry products in granular or powder form. In other respects the elements shown will not be further discussed for having already been discussed with reference to FIGS. 1,2, 3A-3C.

FIGS. 4A-4D show side views (FIGS. 4A,4B), and cross-sectional views (FIGS. 4C,4D) of an alternative embodiment of a topping dispensing arrangement 100' similar to FIGS. 3A-3D.

Figure 4A:
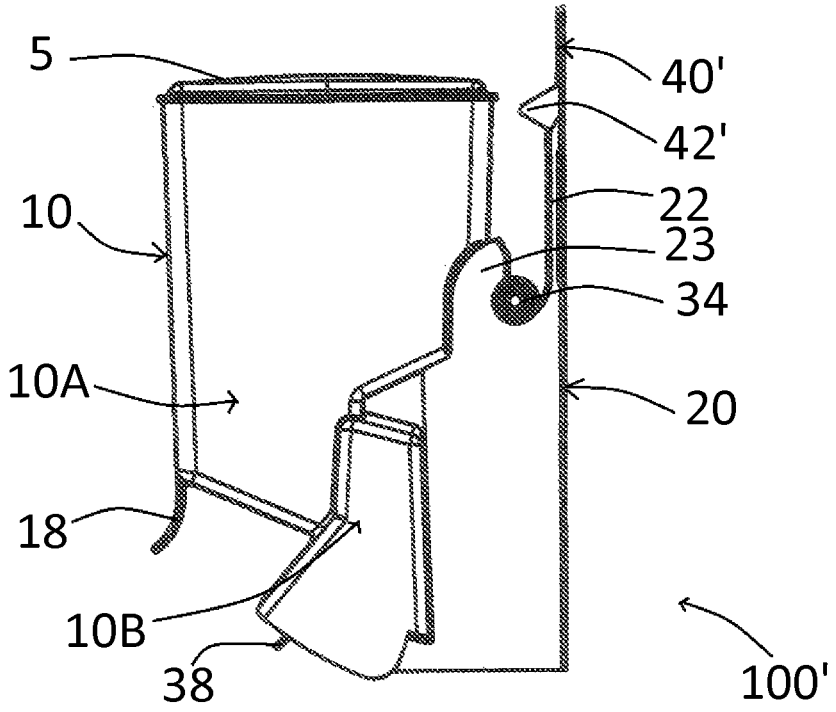
FIG. 4A is a schematic side view of a second embodiment of a dispensing arrangement in a first, closed, state in which dispensing is prevented.
Figure 4B:
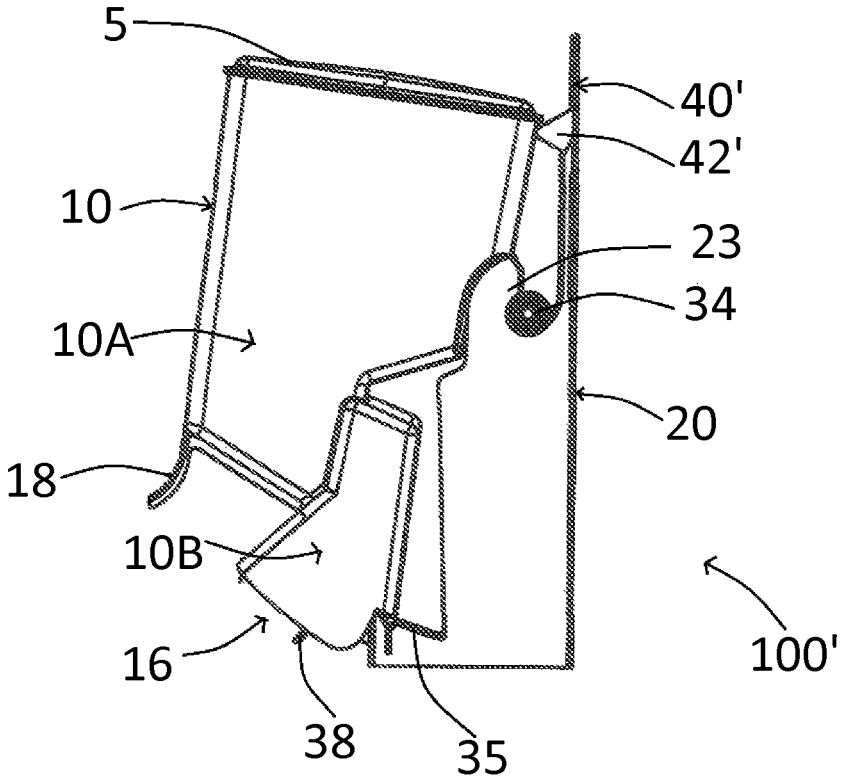
FIG. 4B is a schematic side view of the dispensing arrangement of FIG. 4A in an open, dispensing, state allowing dispensing.
Figure 4C:
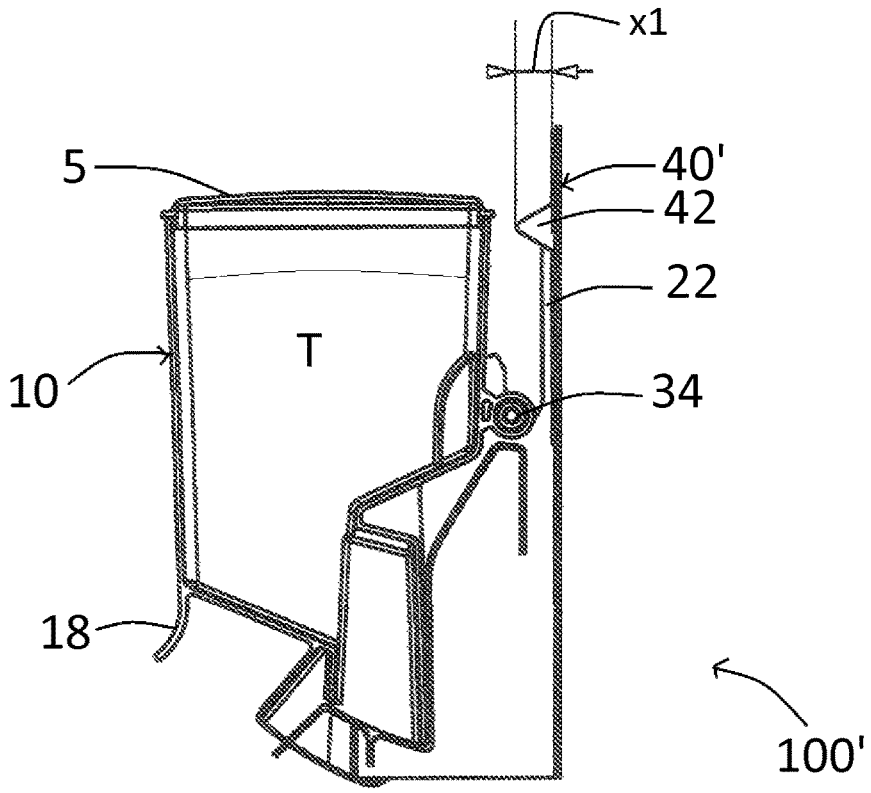
FIG. 4C is a schematic sectional view through the dispensing arrangement in the first, closed, state shown in FIG. 4A.
Figure 4D:
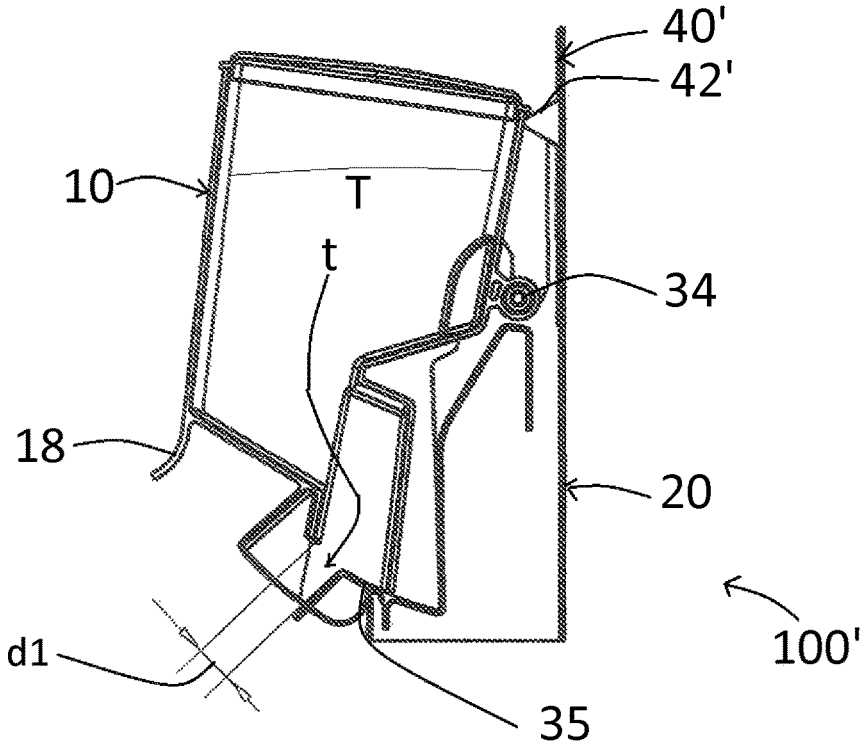
FIG. 4D is a schematic sectional view through the dispensing arrangement in the second, open, dispensing, state shown in FIG. 4B.

The only difference is that a different dispensing control element 40' has been introduced into the bracket element 20 having a larger blocking protrusion 42' protruding length x1, see FIG. 4C, than the protruding length x illustrated in FIG. 3C, thus to a higher degree limiting the rotation movement of the container arrangement 10, and thus limiting the flow output through the container dispensing channel 16, d1 in FIG. 4D illustrating the shorter distance between the lower edge of downwardly protruding container wall 101 and a front edge of the closing element 35. In other respects the elements shown will not be further discussed for having already been discussed with reference to FIGS. 1,2, 3A-3D, the dispensing control element 42' bearing the corresponding reference signs as above but provided with a prime sign (').

FIGS. 5-10 schematically illustrate, in a step by step procedure, assembly of a topping dispensing arrangement 100" which is similar to the dispensing arrangements 100, 100' described above with reference to FIGS. 1-4D in which a dispensing control element 40" is used which has a blocking protrusion 42" having an intermediate protruding length somewhat larger than the protruding length blocking protrusion 42 of the dispensing arrangement 100 and somewhat smaller than the protruding length of the dispensing arrangement 100' blocking protrusion 42'.

Figure 5:
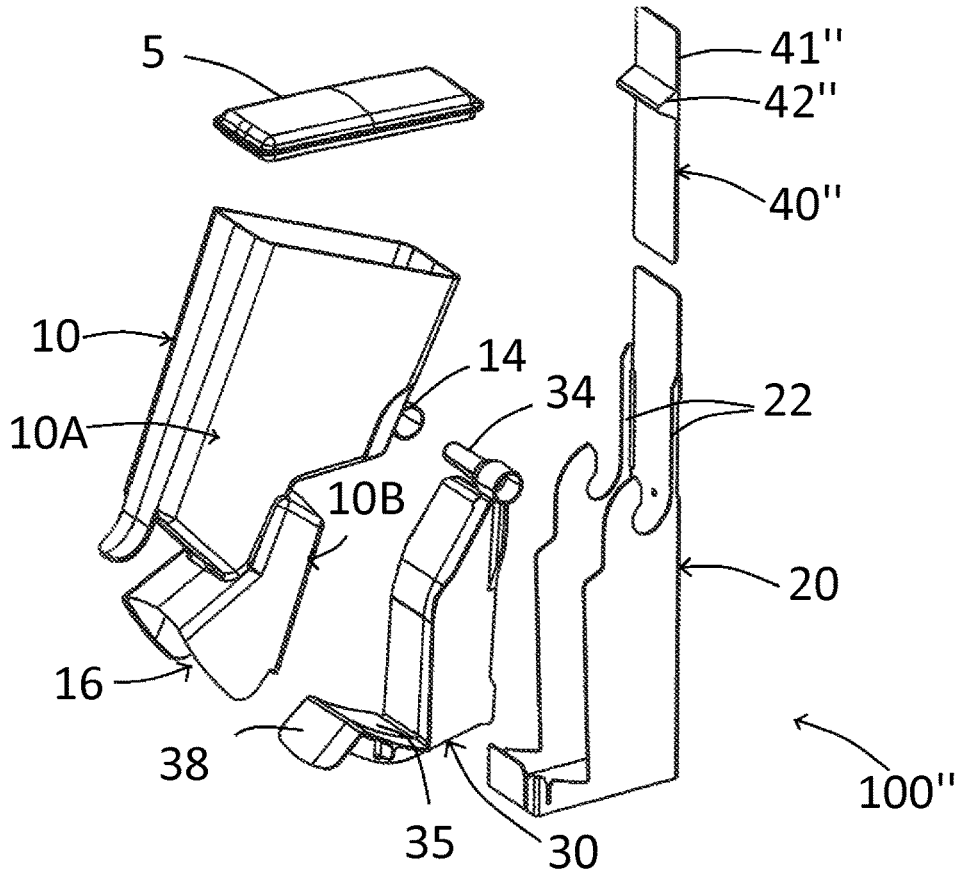
FIG. 5 is an exploded view showing the different elements of a dispensing arrangement in a state to be assembled.

In a first step shown in FIG. 5 the dispensing arrangement is fully disassembled, and a dispensing control element 40" with a blocking protrusion 42" having a suitable protruding length has been selected, depending on the dry or semi-dry products in granular or powder form to be dispensed, e.g. a larger protruding length for a product having a finer granular size and vice versa. This is only one example of a criterion that may be applicable for selecting dispensing control element, the arrow indicating how the dispensing control element 40" is to be introduced into the bracket element 20.

Figure 6:
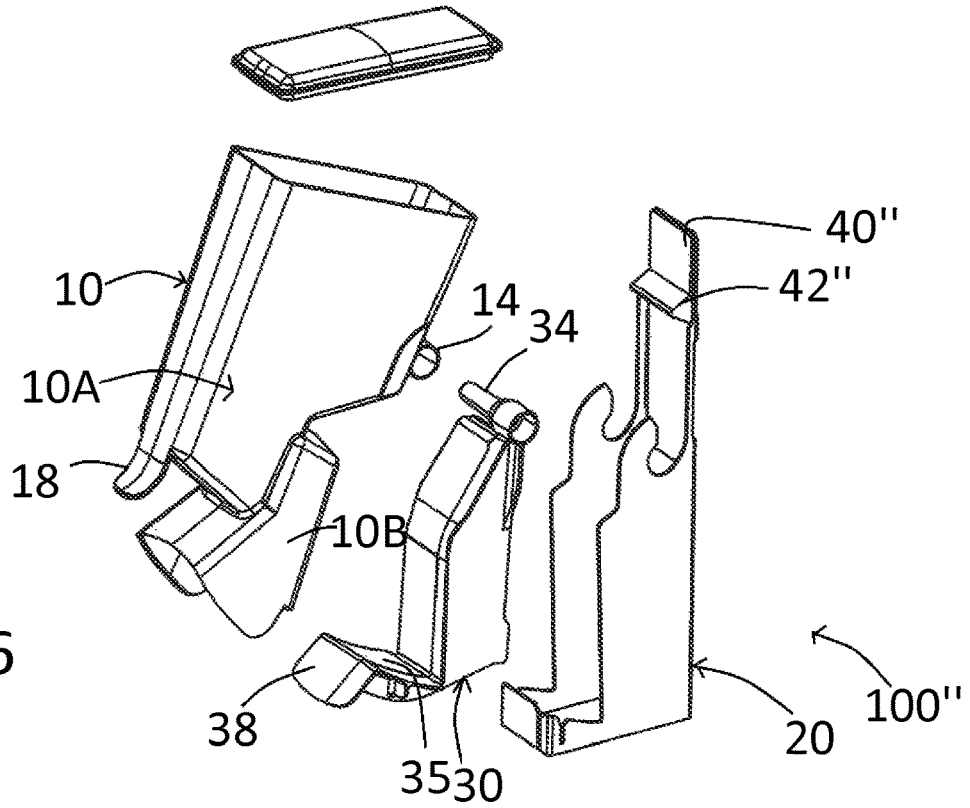
FIG. 6 shows the elements of the dispensing arrangement of FIG. 5 in a first assembling state in which a dedicated dispensing control element has been mounted on a bracket element.

In FIG. 6 the dispensing control element 40" has been introduced into the bracket element 20 and is held safely in place by the flange elements 22,22 as discussed earlier in the application.

Figure 7:
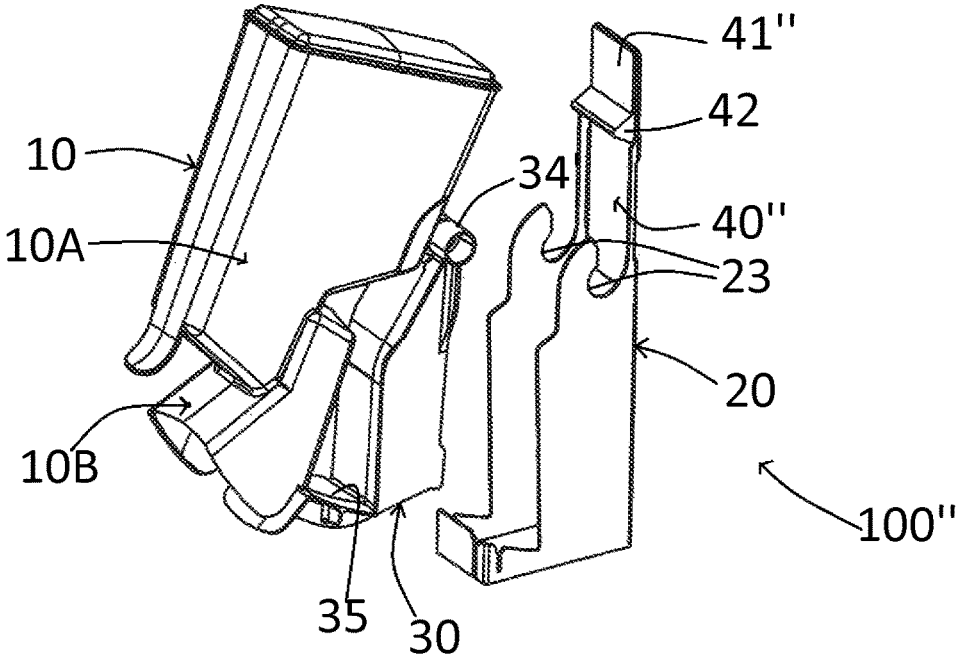
FIG. 7 shows the elements of the dispensing arrangement of FIG. 5 in a second assembling state in which a lid has been mounted on the container arrangement and the container arrangement has been pivotally mounted on the base member through reception on a rear side of a horizontal pivot axis fixedly mounted on an upper part of the base member.

Subsequently, in the step shown in FIG. 7 the lid 15 has been mounted on the containing arrangement 10, and the pivot pin 34 of the base member 30 has been introduced into the tubular element 14 of the container arrangement 10, the container arrangement 10 being located in slightly angled position with respect to the base member 30 to allow taking up of the pivot pin 34.

Figure 8:
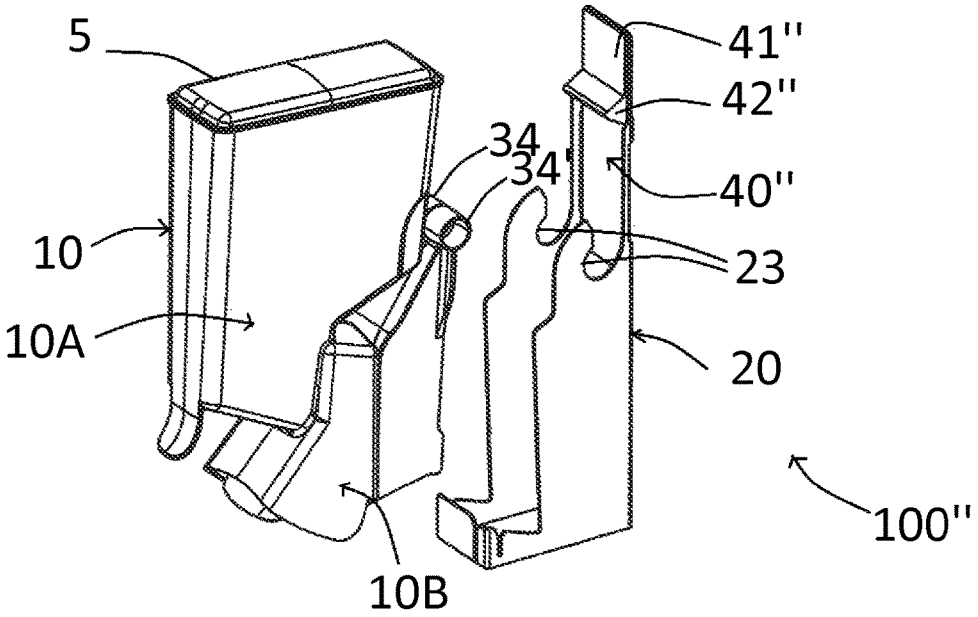
FIG. 8 shows the elements of the dispensing arrangement of FIG. 5 in a third assembling state in which the container arrangement and base member assembly has been disposed in a vertical position allowing releasable mounting on the bracket element.

In a subsequent step shown in FIG. 8 the container arrangement 10 and the base member are fully assembled, which is achieved through rotating the container arrangement 10 counterclockwise around the common pivot pin 34 and the base member 30 front part is partly taken up between the side walls 16',16' as discussed with reference to FIG. 2. The container arrangement 10 and the base member 30 are now vertically aligned, and the container arrangement 10 is supposed to contain a dry or semi-dry product in granular or powder form. (For a filling operation the lid 5 has been removed.) It is an advantage that through the inventive concept, the container arrangement and base member assembly can be handled as one unit with one hand with dry or semi-dry product in granular or powder form in the container without the running the risk of spilling product, and also as one unit with one hand also when there is no product in the container arrangement.

In the step illustrated in FIG. 9 the assembly comprising the container arrangement 10 and the base member 30 is moved to a position vertically above the bracket element 20 such that protruding end portions of the pivot pin 34 or the assembly common shaft protruding on either side of the assembly comprising the container arrangement 10 and the base member 30 are aligned with upwardly open receiving ends of the connection portions 23,23 of the bracket element 20.

In a subsequent step shown in FIG. 10 the assembly comprising the container arrangement 10 and the base member 30 is lowered such that the protruding end portions of the pivot pin 34 or the assembly common shaft protruding on either side of the assembly are taken up within the connection portions 23,23, e.g. forming grooves or hooks for holding the assembly in place also when the container arrangement 10 is rotated for dispensing as described above. Although not shown in FIG. 10 the assembly will be lowered until the protruding end portions of the pivot pin 34 rest on lower inner edges of the connection portions 23,23.

When the dispenser arrangement 100 is operated through rotating the container arrangement 10 by pulling or actuating an actuating element 18 provided on the lower front edge of the container arrangement 10, the container arrangement 100 will be rotated around the common pivot axis 34 until the container dispensing channel 16 is at least partly uncovered, i.e. not covered by closing element 35 allowing dry or semi-dry products in granular or powder form, subjected to a gravitational force, move or flow downwards and out of the container dispensing channel 16 and be dispensed e.g. over a salad or anything else. Rotating the container arrangement 10 further, the outflow will increase. Maximum outflow, or output, is admitted when the upper rear edge of the container arrangement 10 gets in contact and is blocked from further rotation by the dispensing control element 40, and as discussed above different dispensing control elements 40 can be used for different toppings, e.g. of different particle sizes, densities or just different type or depending different needs in general, and it is very easy to just replace one dispensing control elements through another dispensing control element or one blocking protrusion through another. By adjusting the maximum opening angle, the exit flow from the container arrangement 10 can be adjusted to different dry or semi-dry products in granular or powder form through using of a dedicated dispensing flow control element 40 blocking protrusion which will determine the maximum opening angle and thereby the opening area. Each dry or semi-dry product in granular or powder form or product type may come with a specific, pre-defined, dedicated dispensing flow control element 40 that also optionally may contain name and information of the product content. The inventive concept allows for an adjusted setting of the dispensing arrangement without requiring any instructions or training to the user or staff serving the toppings.

Thus, depending on product or particular use or needs, a plurality of dispensing control elements can be used and simply introduced on one and a same bracket element which provides a high flexibility.

FIG. 11A is a schematic cross-sectional view through an alternative embodiment of a dispensing arrangement 100''' in a first, closed, state. Dispensing arrangement 100''' differs from e.g. dispensing arrangement 100 as shown in e.g. in FIGS. 1-3D (cf. in particular FIG. 3C which is a corresponding cross-sectional view taken through dispensing arrangement 100) in that the container arrangement 10''' is differently shaped and does not comprise any additional side wall interconnecting wall (reference numeral 16" in in FIGS. 2,3D), only the downwardly protruding container wall extending downwardly from the front bottom of the upper container section 10A''' serving as upper channel wall 101''', and in that the sloping angle $\alpha 2$ is smaller than corresponding angle $\alpha 1$ shown in FIG. 3C and angle $\beta 2$ is smaller than corresponding angle $\beta 1$ illustrated in FIG. 3D. In addition, the container arrangement 100''' does not contain any wall corresponding to wall 19' of container arrangement 10 shown in FIG. 3C; an option serving the purpose of preventing water from being trapped.

The bracket element 20''' is as in the previously described embodiments adapted to receive and hold a dispensing control element 40''' which is similar to the dispensing control elements described with reference to the preceding embodiments and here comprises a blocking protrusion 42''' having an exemplary protruding length of 15 mm. The bracket element 20''' is as in the previously described embodiments also adapted to receive and hold an assembly formed by container arrangement 10''' and base member 30''', although being differently shaped, however serving the same purpose; the shape and configuration of the bracket element not being of importance as long as it serves the purposes of allowing reception of protruding portions of a pivot pin 34''', and holding the pivot pin 34''' in place, and at the same time releasably holding the containing arrangement 10''' and base member 30''', when assembled, in place, and allowing releasably receiving exchangeable receiving dispensing control elements 40'''. It can be adapted to be mountable on a wall or similar, e.g. a wall of an accessory unit, or even be shaped and dimensioned to form a stand-alone bracket and holding unit. This also applies for the brackets elements described with reference to the previously described embodiment, and to any embodiment covered by the present invention.

FIG. 11B is a schematic cross-sectional view through the dispensing arrangement 100''' of FIG. 1A in a second, open, dispensing, state when the closing element 35''' leaves the container dispensing channel $\mathbf{16}_3$ free, the upper edge 13''' being prevented from further rotation by being in contact with blocking protrusion 42'''.

In an advantageous embodiment the closing element 35''' is made e.g. of a band shaped material acting as a spring or is somewhat resilient and is so disposed that, if food dry or semi-dry product particles or similar are stuck between the upper channel wall 101''' and the closing element 35''', it will give away slightly to avoid the risk of food dry or semi-dry product particles being stuck or crushed.

In advantageous embodiments the dispensing control elements are fixedly or exchangeably or releasably provided with a marking or similar for respective dedicated dry or semi-dry products in granular or powder form thus minimizing the risk of mismatching product exit flow and product.

In alternative embodiments as described with reference to FIGS. 12A-12E below a dispensing flow control element can be adapted to allow for dispensing a plurality, or at least two, different dry or semi-dry products in granular or powder form depending on how the dispensing control element is connected to or associated with the rear wall, e.g. two different positions for two different blocking protrusions, optionally also each of which provided with a marking or similar to indicate type or name of dry or semi-dry product in granular or powder form for which it is suitable etc.

FIG. 12A shows a dispensing arrangement 100'''' in a first, closed, state. Dispensing arrangement 100'''' differs from e.g. dispensing arrangement 100 as shown in e.g. in FIGS. 1-3D in that the container arrangement 10'''', base member 30'''' and bracket element 20'''' are differently shaped but their functional interrelationships are the same as for the previously described dispensing arrangements. Dispensing arrangement 100'''' thus comprises a container arrangement 10'''' with a funnel with a lower exit channel $\mathbf{16}_4$ (cf. FIG. 12B) forming a dispensing aperture, a bracket element 20'''' and a base member 30'''' with a closing element $\mathbf{35}_4$ and the container arrangement 10'''' is pivotally mountable to base member 30'''' allowing rotation around a pivot shaft $\mathbf{34}_4$ of the base member 30'''' as described with reference to the embodiments shown in FIGS. 1-11B. The base member and the container arrangement will not be described in detail since the functioning is similar to what has been described with reference to FIGS. 1-11B and will therefore not be further described here. In the shown embodiment the bracket element 20'''' is in a similar manner as described above provided with two connection portions $\mathbf{23}_4$, $\mathbf{23}_4$ allowing reception of the pivot pin, or shaft, $\mathbf{34}_4$ protruding on either sides of an assembly comprising the container arrangement 10'''' and the base member 30'''' in an assembled state and forming a pivot axis, such that the base member 30'''' will be taken up between side wall portions of the bracket element 20'''' as also described with reference to the embodiments shown in FIGS. 1-11B.

The dispensing control element 40'''' here comprises a flat substantially circular plate $\mathbf{41}_4$ (cf. FIGS. 12D-12F) with a central hole 46 allowing reception of a mounting element (not shown) for securing it adjustably e.g. to a rear wall $\mathbf{20}_4$ of the bracket element 20'''', or to a wall behind bracket element 20''''.

In the shown embodiment the dispensing control element 40'''' comprises three blocking protrusions $\mathbf{42}_1$,$\mathbf{42}_2$,$\mathbf{42}_3$ located adjacent the periphery of the circular control element, at 120° angular distances from each other such that, depending on which dry or semi-dry products in granular or powder form or type thereof that is to be dispensed, one of the three blocking protrusions $\mathbf{42}_1$,$\mathbf{42}_2$,$\mathbf{42}_3$ can be selected to be in an operative position by adjusting the dispensing control element 40'''' through rotating it with respect to the rear wall $\mathbf{20}_4$ of the bracket element 20'''' and securing it in the appropriate position, e.g. such that the selected blocking protrusion is in an uppermost position; in FIG. 12A blocking protrusion $\mathbf{42}_2$. It should be clear that the dispensing control element 40'''' can be rotated with respect to the rear wall $\mathbf{20}_4$ of the $\mathbf{13}_4$ of the bracket element 20'''' and secured in a desired position in many different ways, e.g. through any appropriate, locking mechanism, e.g. a mechanical locking mechanism, by means of a spring loaded locking pin, lock nuts, lock washers, locking clips or plates or a simple clutch mechanism on the rear side of the dispensing control element 40'''' cooperating with an element on the rear wall $\mathbf{20}_4$ of the bracket element 20'''' or vice versa or by means of a magnetic locking mechanism.

In one embodiment the rear side of the, here, circular plate $\mathbf{41}_4$ of dispensing control element 40'''' is provided with grooves (not shown) or similar adapted to be fitted to a ridge or similar on rear wall $\mathbf{20}_4$ of the bracket element 20'''', one groove for each blocking protrusion $\mathbf{42}_1$,$\mathbf{42}_2$,$\mathbf{42}_3$, such that when the circular plate $\mathbf{41}_4$ of dispensing control element 40'''' is rotated, the ridge and a selected groove will snap in, and it will be locked in in an operative position. Preferably, but not necessarily the circular plate $\mathbf{41}_4$ of dispensing control element 40'''' is elastic, e.g. made of a plastic material, facilitating a snap-in locking.

Blocking protrusions $\mathbf{42}_2$ $\mathbf{42}_1$,$\mathbf{42}_2$,$\mathbf{42}_3$ are directed outwards in a direction perpendicular to the circular plate $\mathbf{41}_4$ of dispensing control element 40'''' and protrudes in a horizontal direction in a mounted state of the dispensing arrangement 100''''. In FIG. 12A blocking protrusion $\mathbf{42}_2$ is in an operative position is arranged to block a rotational movement of the container arrangement 10'''' beyond a predetermined angle around the pivot shaft $\mathbf{34}_4$, acting as a rotation end stop of the container arrangement 10'''' during a dispensing operation by the rear wall $\mathbf{13}_4$ of the container arrangement 10'''' getting in contact with the blocking protrusion $\mathbf{42}_3$.

For different dry or semi-dry food products in granular or powder form or similar the dispensing control element 40"" may thus be rotated allowing selection of an appropriate blocking protrusion, i.e. a blocking protrusion having an appropriate protruding length. In particular embodiments a dispensing control element having a circular, or any other appropriate, shape with two or more blocking protrusions may be exchanged through another dispensing control element having blocking protrusions with still other different protruding lengths. The blocking protrusions may be fixedly connected to the circular plate $\mathbf{41}_4$ of dispensing control element 40"", or be made integrally therewith, or even be releasably connected thereto.

FIG. 12B is a schematic view in perspective of the dispensing arrangement 100"" of FIG. 12A in a second, dispensing, state when the closing element $\mathbf{35}_4$ leaves the container dispensing channel $\mathbf{16}_4$ free, the container arrangement 10"" being prevented from further rotation through its rear wall getting in contact with blocking protrusion $\mathbf{42}_2$. The essential functioning is similar to that described with reference to the embodiments described above and will therefore not be further described.

Figure 12C:
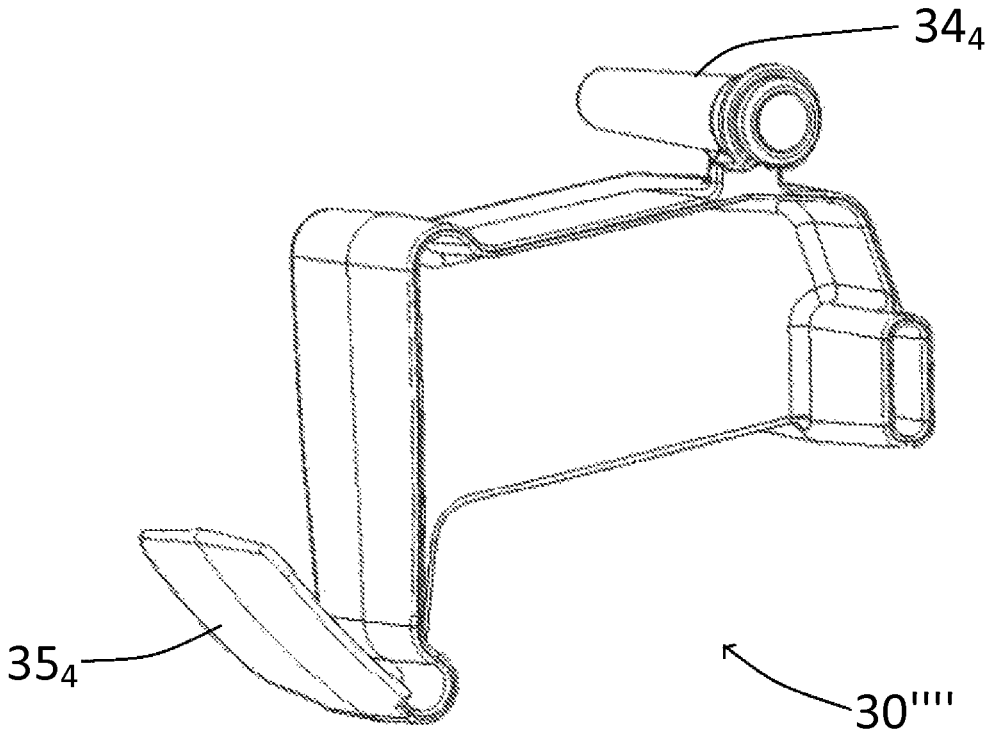
FIG. 12C is a schematic enlarged view in perspective of the base member of the dispensing arrangement of FIG. 12A.

FIG. 12C is a schematic enlarged view in perspective of the base member 30"" of the dispensing arrangement 100"" shown in FIGS. 12A, 12B illustrating the closing element $\mathbf{35}_4$ and the pivot shaft $\mathbf{34}_4$ adapted for reception by connection portions $\mathbf{23}_4$, $\mathbf{23}_4$ of bracket element 20"". It should be clear that this is only an exemplary implementation of a base member according to the inventive concept.

Figure 12D:
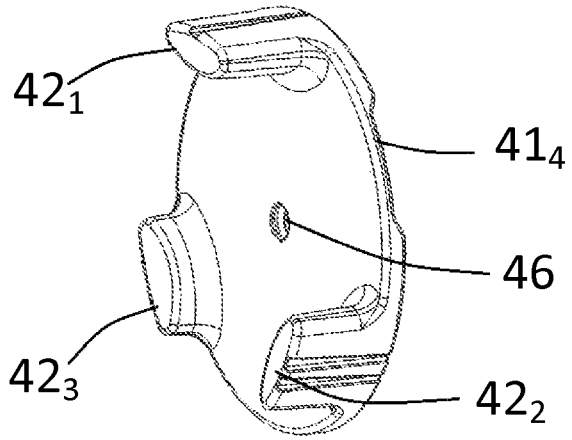
FIG. 12D is a schematic view of an alternative embodiment of a dispensing control element as shown in FIG. 12A, here in a first position.

FIG. 12D is a schematic view of the dispensing control element 40"" shown in FIG. 12A in a first position wherein a first blocking protrusion $\mathbf{42}_1$ is in an operative position, located at an upper position of the dispensing control element 40"" for blocking the dispensing arrangement from further rotation as discussed above.

Figure 12E:
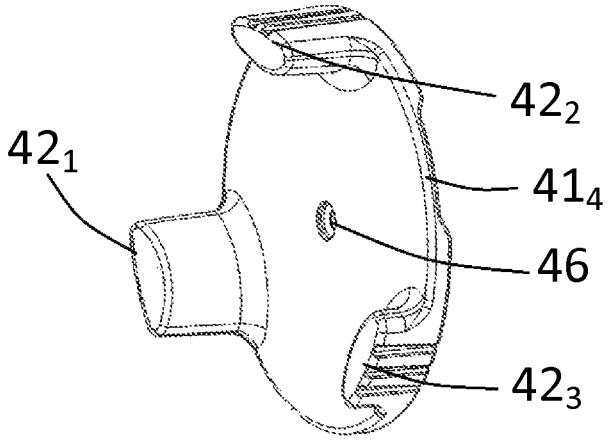
FIG. 12E is a schematic view of the dispensing control element shown in FIG. 12 C, in a second position as shown in FIGS. 12A and 12B.

FIG. 12E is a schematic view of the dispensing control element 40"" shown in FIG. 12D, in a second position, as shown in FIGS. 12A and 12B, rotated through 120° with respect to the first position and in which a second blocking protrusion $\mathbf{42}_2$ is in the operative position. In the shown embodiment the second blocking protrusion $\mathbf{42}_2$ has a protruding length with respect to the planar extension of the circular plate $\mathbf{41}_4$ of dispensing control element 40"" which is shorter than the protruding length of the first blocking protrusion $\mathbf{42}_1$.

Figure 12F:
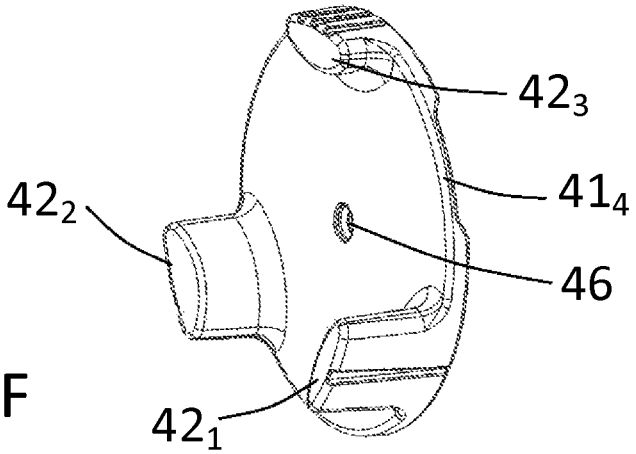
FIG. 12F is a schematic view of the dispensing control element shown in FIG. 12 C in a third position.

FIG. 12F is a schematic view of the dispensing control element shown in FIG. 12D in a third position in which it is rotated through 120° with respect to the second position and in which a third blocking protrusion $\mathbf{42}_3$ is in the operative position. In the shown embodiment the third blocking protrusion $\mathbf{42}_3$ has a protruding length with respect to the planar extension of the circular plate $\mathbf{41}_4$ of dispensing control element 40"" which is shorter than the protruding length of the second blocking protrusion $\mathbf{42}_2$.

It should be clear that a dispensing control element may have two, three, four or even more blocking protrusions having different protruding lengths. The blocking protrusions of a dispensing control element may also be differently angularly disposed. Also, the dispensing control element does not have to have a circular shape but may have any other appropriate shape.

Thus, according to the inventive concept a food or topping dispensing arrangement for sprinkling dry or semi-dry products in granular or powder form of various particle sizes and of various consistencies, e.g. over a salad, is provided. The exit flow with which dry or semi-dry products in granular or powder form are dispensed is regulated through the use of the exchangeable and/or adjustable dispensing control elements, which allows for a suitable flow for different dry or semi-dry products in granular or powder form. Said dispensing control elements may also optionally be adapted for reception of e.g. a name and information label for specific products thereon, to provide customers with information and simplify usage for operators. Alternatively information is preprinted or similar on the dispensing control, elements or in association with different blocking protrusions if a dispensing control element comprises more than one blocking protrusion.

It should be clear that the invention is not limited to the specifically illustrated embodiments but that it can be varied in a number of ways within the scope of the appended claims, and implemented with, or comprise, different types and shapes of bracket or mounting elements, different types and shapes of dispensing control elements as long as they are adjustable and/or exchangeable and available for different types of dry or semi-dry products in granular or powder form, providing different maximum rotational angles for a container arrangement, and can be easily mounted on/demounted from the bracket or mounting element. Also, the container arrangement and the base member can be of different sizes and shapes as long as the base member and the container arrangement are fitted to be mountable to each other via a horizontal pivot axis or shaft allowing the container arrangement to be rotated with different angles allowing a controllable output or exit flow wherein the base member at least assists in blocking the output flow in a non-operating position and wherein the assembly is releasably mounted on the bracket or mounting element.

It is an advantage that the dispensing flow control elements can be manufactured from a low-cost flat material that can be altered without any major tooling investment.

It is also an advantage that, through the inventive concept, only a are few parts require regular cleaning; the container arrangement, the base member and the lid; the bracket member and the dispensing flow control element not getting in contact with the dry or semi-dry products in granular or powder form.

In some implementations a number of dispensing arrangements according to the present invention may be used in association with a food bar arrangement as described in e.g. WO 2016175696 or SE2050772-9 which are designed to let a customer or end user collect a bowl, then continue around the food bar arrangement and fill the bowl with fresh food products and end up at an accessory unit where the dispensing arrangements are mounted. The customer can then selects one or multiple dry or semi-dry products in granular or powder form to sprinkle over the salad to finish the meal preparation.

The present invention particularly concerns dispensing arrangements used in connection or nearby food bar arrangements where food products are offered in loose weight or as loose products, but it is of course also applicable in other environments when dispensing of dry or semi-dry products in granular or powder form is desired.

The invention claimed is:

1. A dispensing arrangement for dispensing dry or semi-dry products comprising granules, grains, powder or particles, or toppings for food products, comprising:

a refillable container arrangement for holding said dry or semi-dry products;

a funnel with a container dispensing, exit, channel with a lower open end forming a dispensing aperture;

a support structure comprising a bracket element adapted for reception of and holding the container arrangement;

a base member with a closing element;

the container arrangement being pivotally mountable to the base member such that the container arrangement can be rotated with respect to the base member around a horizontal pivot shaft or axis between a first end position in which the closing element covers the container dispensing, exit, channel lower open end forming the dispensing aperture, thus preventing said dry or semi-dry products dispensing, and a second end position in which a maximum predetermined flow is allowed in which the closing element at least partly reveals the container dispensing exit channel lower open end;

at least one releasable and/or adjustable dispensing control element comprising at least one protruding portion protruding in a horizontal direction in an assembled state of the dispensing arrangement for limiting a maximum rotation of the container arrangement by blocking the container arrangement from rotating beyond a predetermined rotation angle through a rear portion of the container arrangement coming in contact with the at least one protruding portion when the container arrangement is rotated; and the maximum predetermined flow through the container dispensing exit channel can be controlled depending on which is the dry or semi-dry products to be dispensed through arranging or selecting the at least one dispensing control element with a length of the predetermined protruding portion for blocking the container arrangement from rotating beyond the predetermined rotation angle.

2. The dispensing arrangement according to claim 1, wherein the container arrangement comprises an actuating element for pulling or gripping by an end user for dispensing the toppings through pivoting or rotating the container arrangement.

3. The dispensing arrangement according to claim 2, wherein the actuating element comprises a protruding portion of a front wall of the container arrangement.

4. The dispensing arrangement according to claim 1, wherein the container arrangement and the base member are adapted to be releasably interconnectable through the pivot shaft, which is horizontally disposed on the base member, in a mounted state of the dispensing arrangement being receivable in a rear tubular member or bushing of the container arrangement while the base member partly is taken up between lower side wall portions of the container arrangement, hence forming the container arrangement and base member assembly, the closing element being disposed at a lower forward end of the base member.

5. The dispensing arrangement according to claim 1, wherein the bracket element comprises connection means allowing releasable reception of an assembly comprising the container arrangement and the base member when assembled, such that the base member will be taken up between side walls of the bracket element, through vertical reception of protruding portions of the pivot shaft within the connection means comprising hook-shaped connection portions preventing horizontal movement of the container arrangement and base member assembly.

6. The dispensing arrangement according to claim 1, wherein the container dispensing channel is formed by parallel side walls of a lower container portion of the container arrangement, a rear vertical wall interconnecting the two parallel side walls forming a bottom portion of the container dispensing or exit channel and a downwardly protruding wall forming a front channel wall extending in parallel with said rear vertical wall, the channel walls and the closing element being so dimensioned and shaped with respect to one another that, when the container arrangement is rotated outwards around the pivot shaft to a dispensing state, the closing element will gradually move to uncover the container dispensing channel which will be gradually opened.

7. The dispensing arrangement according to claim 1, wherein the closing element is elastic or resilient so that if product particles are stuck in the container dispensing channel between upper dispensing channel walls and the closing element, the closing element will give away slightly to avoid the risk of the product particles getting stuck or being crushed.

8. The dispensing arrangement according to claim 1, wherein the at least one dispensing control element comprises two or more protruding portions extending in a direction perpendicular to the planar extension of the at least one dispensing control element at a distance from each other for allowing use of different container arrangement sizes and/or for allowing different maximum rotation angles of the container arrangement.

9. The dispensing arrangement according to claim 1, wherein the at least one dispensing control element comprises a flat element with in a horizontal direction protruding portion releasably receivable in the bracket element.

10. The dispensing arrangement according to claim 1, wherein the bracket element comprises a channel or flanges allowing releasable reception of a selected, dedicated, one of the at least one dispensing control element while holding a received or mounted one of the at least one dispensing control element in place in a mounted or state of the dispensing arrangement.

11. The dispensing arrangement according to claim 1, wherein the bracket element channel or flanges allowing releasable reception of selected, dedicated, one of the at least one dispensing control element is/are so arranged that a received or releasably mounted one of the at least one dispensing control element will be located such that the at least one protruding portion will block further rotation of the container arrangement through coming in contact with an upper rear portion of the container arrangement, of a rear wall.

12. The dispensing arrangement according to claim 1, wherein the dispensing control element comprises an adjustably mountable, flat, plate, to the bracket element, comprising two or more blocking protrusions having different protruding lengths and in that the at least one dispensing control element can be adjusted and secured in a respective position corresponding to each of said two or more blocking protrusions allowing selection of blocking protrusion protruding length to be in an operative position for blocking the rotation of the container arrangement depending on a type of said dry or semi-dry products to be dispensed.

13. The dispensing arrangement according to claim 12, wherein the flat plate of the at least one dispensing control element comprises a circular plate rotatably secured to the bracket element or to a wall onto which the bracket element is secured, and in that the at least one dispensing control element can be rotated through one or more angles and be secured in corresponding positions such that a selected blocking protrusion will be in an operative position allowing blocking the container arrangement from rotating beyond a predetermined angle, corresponding to a selected setting.

14. The dispensing arrangement according to claim 13, further comprising three or more blocking protrusions having different protruding lengths regularly angularly disposed adjacent the periphery of the at least one dispensing control element.

15. The dispensing arrangement according to claim 1, wherein the at least one dispensing control element is provided with a fixed or releasable marking for each of the least one protruding portion for respective dedicated said dry or semi-dry products, having predetermined or maximum allowable granular or particle sizes or dimensions to reduce or minimize a risk of mismatching said dry or semi-dry products exit flow.

* * * * *